US008651297B2

(12) United States Patent
Beaty

(10) Patent No.: US 8,651,297 B2
(45) Date of Patent: Feb. 18, 2014

(54) MULTI-PLY LAMINATED CORRUGATED DISPLAY RACK WITH A BACK WALL AND SUPPORT RODS BETWEEN SHELVES

(75) Inventor: Travis E. Beaty, Denver, NC (US)

(73) Assignee: International Paper Co., Memphis, TN (US)

( * ) Notice: Subject to any disclaimer, the term of this patent is extended or adjusted under 35 U.S.C. 154(b) by 186 days.

(21) Appl. No.: 13/228,723

(22) Filed: Sep. 9, 2011

(65) Prior Publication Data

US 2013/0062299 A1 Mar. 14, 2013

(51) Int. Cl.
*A47F 5/00* (2006.01)

(52) U.S. Cl.
USPC ..... 211/135; 211/72

(58) Field of Classification Search
USPC ..... 211/72, 73, 71.01, 189, 135; 206/740, 206/744; 220/4.28, 4.29, 690, 689; 108/180, 193, 101; 312/263, 265.5, 312/257.1
See application file for complete search history.

(56) References Cited

U.S. PATENT DOCUMENTS

| | | | | | |
|---|---|---|---|---|---|
| 1,192,207 | A * | 7/1916 | Kahn | 403/174 |
| 2,366,676 | A * | 1/1945 | Rosenthal | 108/180 |
| 2,825,101 | A * | 3/1958 | Rubenstein | 403/217 |
| 3,362,610 | A * | 1/1968 | Van Dyke | 229/120.33 |
| 3,656,611 | A * | 4/1972 | Mertz | 206/764 |
| 3,788,700 | A * | 1/1974 | Wartes | 297/440.13 |
| 3,987,737 | A * | 10/1976 | Smith | 108/179 |
| 4,082,389 | A * | 4/1978 | Stewart | 312/258 |
| 4,140,065 | A * | 2/1979 | Chacon | 108/156 |
| 4,153,311 | A * | 5/1979 | Takahashi | 312/107 |
| 4,191,113 | A * | 3/1980 | Hogberg | 108/157.16 |
| 4,232,916 | A * | 11/1980 | Correia | 312/107 |
| 4,373,449 | A * | 2/1983 | Klaus et al. | 108/60 |
| 4,506,790 | A * | 3/1985 | Muscari | 211/59.4 |
| 4,809,847 | A * | 3/1989 | Schneider | 206/45.28 |
| 4,832,421 | A * | 5/1989 | Shoffner | 312/263 |
| 5,279,232 | A * | 1/1994 | Gollick | 108/109 |
| 5,458,411 | A * | 10/1995 | Moss | 312/259 |
| 5,669,683 | A * | 9/1997 | Moss et al. | 312/259 |
| 5,832,689 | A * | 11/1998 | Curll | 52/656.9 |
| 6,126,022 | A * | 10/2000 | Merkel | 211/135 |
| 6,267,255 | B1 * | 7/2001 | Brush | 211/59.4 |
| 6,382,433 | B1 * | 5/2002 | Podergois | 211/195 |
| 6,675,979 | B2 * | 1/2004 | Taylor | 211/186 |
| RE38,707 | E * | 3/2005 | Merkel | 211/135 |
| 7,252,200 | B1 * | 8/2007 | Hester | 211/72 |
| 7,686,173 | B2 * | 3/2010 | Robinson et al. | 211/190 |
| 8,091,715 | B2 * | 1/2012 | Roth | 211/187 |
| 8,157,112 | B2 * | 4/2012 | Bojie | 211/135 |
| 2006/0070911 | A1 * | 4/2006 | Lowry | 206/736 |
| 2006/0157484 | A1 * | 7/2006 | Rogotner | 220/4.28 |
| 2013/0062293 | A1 | 3/2013 | Beaty | |
| 2013/0062294 | A1 | 3/2013 | Beaty | |
| 2013/0098909 | A1 * | 4/2013 | Sitton | 220/4.28 |

* cited by examiner

*Primary Examiner* — Jennifer E Novosad
(74) *Attorney, Agent, or Firm* — Matthew M. Eslami

(57) ABSTRACT

A freestanding display rack for supporting and displaying product at a point of sale comprises a pair of spaced apart side panels. A back panel is attached to the side panels by inter-fitting tabs and notches along adjacent edges of the back panel and the side panels. A plurality of shelves extends between and supported at their opposite ends on the side panels by mechanical interlocking engaged between the shelves and the side panels. The mechanical interlocking comprises a slot formed through the side panels adjacent each of the shelves and a tongue projecting outwardly from each end of the shelves. The tongues extend through the respective slot in the side panels and being folded against an outer surface of the respective side panel. A graphics header extends above the shelves and side panels.

18 Claims, 34 Drawing Sheets

MULTI-PLY LAMINATED CORRUGATED DISPLAY RACK WITH A BACK WALL AND SUPPORT RODS BETWEEN SHELVES

FIELD OF THE INVENTION

This invention relates generally to display racks for supporting and displaying product at a point of sale. More particularly, the invention relates to a fully recyclable display rack made of interlocking panels of fiber-based material such as containerboard, wherein the rack may be shipped disassembled in a compact package and quickly and easily assembled at a point of sale without requiring the use of tools.

BACKGROUND OF THE INVENTION

Many products for sale to the general public are commonly supported and displayed at the point of sale on free-standing racks placed in prominent locations for maximum visibility and easy access to the product. Graphics are commonly applied to the racks to enhance visual attraction to the displayed product. These racks must be of sturdy construction to support the weight of the displayed product and to withstand the rigors of prolonged use in a retail environment. Accordingly, conventional racks of this type are typically constructed from permanent display materials such as wood, metal, and plastics. These displays are fairly costly to manufacture and ship, making them expensive to purchase and to deploy through direct store delivery (DSD) systems. If they are shipped unassembled, substantial labor and the use of tools is generally required to erect them at the point of sale. Further, they are not easily recyclable and are never or rarely recycled, ending up instead in landfills.

It would be desirable to have a stand-alone display rack for displaying product at a point of sale, wherein the rack is fully recyclable, may be shipped disassembled in a compact package, and may be easily and quickly assembled at the point of sale without requiring the use of tools.

SUMMARY OF THE INVENTION

The present invention comprises a stand-alone display rack for displaying product at a point of sale, wherein the rack is fully recyclable, may be shipped disassembled in a compact package, and may be easily and quickly assembled at the point of sale without requiring the use of tools.

The display rack is constructed from a plurality of mechanically interlocked structural components and graphics panels made of 100% recyclable fiber-based materials such as containerboard, whereby the rack can be recycled very efficiently by utilizing existing fiber recycling supply chains at retailers or by utilizing the vendor's internal supply chains. The structural components are made of laminated sheets of material and are held in assembled relationship by interfitting tabs, notches and slots. The components are extremely lightweight, particularly relative to their strength, are easy to transport, and are capable of being set-up within the retail environment in less than 6 minutes. The manner in which the various structural components and graphics panels fit together, as described hereinafter, provides a distinct advantage in terms of structural performance and ease of assembly, permitting the display racks of the invention to be efficiently deployed in the retail environment.

In a first preferred form of the invention the structural components include opposite side panels and shelves supported by the side panels, with the shelves and product supported thereon being visible and accessible both at the front and at the back of the display rack. The side panels comprise laminated sheets of corrugated material, and have spaced slots formed therein. The shelves comprise laminated doublewall sheets wrapped in a singlewall outer layer. This design provides superior strength across the span of the shelf and also provides finished exposed edges. Tabs on the ends of the shelves are inserted through the slots in the side panels, and locking pins are inserted through openings in the ends of the tabs that project through the slots to prevent withdrawal of the tabs from the slots. Graphics panels are held on the side panels by tongues on the graphics panels inserted through the openings in the projecting ends of the tabs on the shelves.

In a second preferred form of the invention, the structural components include a back panel, opposite side panels, and shelves supported by the back panel and side panels. Interfitting tabs and notches along adjacent side edges of the back and side panels hold the back and side panels in aligned assembled relationship. The side panels comprise laminated sheets of material forming channels extending front-to-back, and the shelves have flanges formed on their opposite side edges that engage in the channels on the side panels. The back panel has spaced slots, and tabs extending from a rearward edge of the shelves extend through the slots. As in the previous form of the invention, a locking pin is inserted through an opening in the end of the tab that project through the slot. Graphics panels are applied to the side panels.

In a third preferred form of the invention, the structural components include a back panel, opposite side panels, shelves supported by the back panel and side panels, and support rods extending between the shelves near forward edges thereof. Interfitting tabs and notches along adjacent side edges of the back and side panels hold the back and side panels in aligned assembled relationship. The shelves in this form of the invention also comprise laminated doublewall sheets wrapped in a singlewall outer layer. The back panel has spaced slots formed therein, and the side panels have spaced openings in substantially the same plane as the slots in the back panel when the components are assembled. First tabs projecting from the rearward edge of the shelves extend through the slots in the back panel, and second tabs projecting from opposite ends of the shelves extend through the openings in the side panels. A locking pin is inserted through an opening in the end of the tabs that project through the slots. A graphics panel extends across the outside of the back panel and the side panels. Tabs on forward edges of the graphics panel wrap around the forward edges of the side panels and are frictionally engaged between adjacent shelves to hold the graphics panel in place.

In a variation of the third form of the invention, the structural arrangement is essentially the same, but the graphics panel differs in that it has a first part that extends over a portion of the back panel, a second part extending across one side panel, and a third part extending over a portion of the front of the display rack. The tabs on the shelves that extend through slots in the back panel also extend through slots in the first part of the graphics panel, and the locking pins inserted through the projecting ends of the tabs hold the first part of the graphics panel to the back panel. Adhesive means on the third part secures the third part to the forward edges of the shelves, and together with the tabs and locking pins at the back panel serve to hold the graphics panel to the display rack.

A graphics panel header is provided in all forms of the invention.

Composition of the corrugated materials on certain key structural components preferably includes treatment to enhance resistance to moisture and humidity that the display will naturally encounter in the retail environment, therefore extending the useful life of the display. A material suitably treated is Clima-Guard® containerboard by International Paper Company.

The display rack is packaged in lightweight, easy to transport compact kit form for distribution and set-up by the vendor's Direct Store Delivery (DSD) supply chain. Assembly of the components at the point of sale is intuitive, does not require any tools, and set-up can be accomplished in a few minutes.

The display rack possesses the structural strength to support up to 400 pounds of products, can last in the retail environment under a full load of product, and can sustain the rigors of "shopping/store" activity for up to 6 months. This ability provides CPG/retailers with a viable option when faced with having to display heavy products for long periods of time at retail.

The recyclability of the display racks of the invention is a positive development in meeting market demand for more environmentally responsible display solutions, especially considering that they are a replacement for displays constructed primarily from permanent materials.

The structural engineering of the laminated corrugated components provides superior strength performance across the span of the shelves and the support of the body components i.e., sides and back.

The display racks of the invention have the ability to serve as a replacement for existing display vehicles that are constructed from permanent materials such as wood, metal, and plastics. This will lower the cost of the display and dramatically improve the chances that the display will be recycled at the end of its useful life.

Construction of the display rack from 100% recyclable fiber-based materials helps satisfy the market needs for more environmentally responsible solutions in the display industry.

Because of these features of the display rack of the invention, it can be advantageously applied across all channels of retail trade, including mass, grocery, drug, club, and specialty.

Accordingly, one aspect of the present invention is directed to a freestanding display rack for supporting and displaying product at a point of sale comprises a pair of spaced apart side panels. A back panel is attached to the side panels by interfitting tabs and notches along adjacent edges of the back panel and the side panels. A plurality of shelves extends between and supported at their opposite ends on the side panels by mechanical interlocking engaged between the shelves and the side panels. The mechanical interlocking comprises a slot formed through the side panels adjacent each of the shelves and a tongue projecting outwardly from each end of the shelves. The tongues extend through the respective slot in the side panels and being folded against an outer surface of the respective side panel. A graphics header extends above the shelves and side panels. The back panel has a plurality of slots formed therethrough and each of the shelves has at least one tab integral with a rearward edge thereof. The at least one tab extends through one of the plurality of slots to attach the shelves to the back panel.

Openings is formed in an end of each of the tab projecting through the respective plurality of slot and a locking pin is engaged in each of the openings to prevent withdrawal of the respective tabs from the respective slots. The tongues project outwardly from the shelves in generally coplanar relationship with a top surface of the respective shelf and a small tab projects outwardly from each of the shelf in generally coplanar relationship with a bottom surface of the respective shelf and immediately adjacent and below each of the tongue, the tabs being received in the same slots that the tongues are extended through. The plurality of slots comprise first and second horizontally spaced apart columns of vertically arrayed slots. At least one tab on a rearward edge of each of the shelf comprises first and second tabs, the first tabs is positioned to extend through the slots of the first column and the second tabs is positioned to extend through the slots of the second column. The side panels each have a width only approximately half the distance between front and back edges of the shelves. Shelf supports extend between adjacent shelves and comprises a pole located at each of the outer front corners of the shelves, opposite ends of the poles being seated in openings in respective top and bottom surfaces of the shelves.

A skirt assembly is positioned beneath the bottom shelf in the display rack. The skirt assembly includes a pair of support poles adapted to contact a supporting surface on which the display rack rests and is in axial alignment with the poles extending between the shelves. A separate graphics wrap is applied to the display rack. The graphics wrap has a wrap back panel overlying the back panel of the display rack and opposite side panels overlying the side panels of the display rack. Flaps on forward edges of the graphics wrap are folded inwardly between each pair of adjacent shelves and frictionally engaged at top and bottom edges thereof between adjacent shelves to hold the graphics wrap in place on the display rack. A separate graphics wrap is applied to the display rack wherein the graphics wrap has a wrap back panel overlying a portion of the back panel of the display rack, one side panel overlying one side panel of the display rack, and a front panel overlying a portion of the front of the display rack.

The wrap back panel of the graphics wrap has a plurality of vertically arrayed slots formed therein and one of the first and second tabs projecting through the slots of one of the first and second columns of slots being extended through the slots in the back panel of the graphics wrap and adhesive means are on an inner surface of the front panel of the graphics panel in positions corresponding to the locations of the shelves. The adhesive means securing the front panel of the graphics wrap to the front of the rack.

Another aspect of the present invention is directed to a freestanding display rack for supporting and displaying product at a point of sale. The display rack is made entirely of materials that can be recycled efficiently by utilizing existing fiber recycling chains and can be shipped to the point of sale in a knocked-down flattened condition in a compact package and quickly and easily assembled at the point of sale without using tools. The display rack comprises a pair of spaced apart side panels and a back panel attached to the side panels by interfitting tabs and notches along adjacent edges of the back panel and the side panels. A plurality of shelves extend between and supported at their opposite ends on the side panels by mechanical interlocking engaged between the shelves and the side panels. The mechanical interlocking comprises a slot formed through the side panels adjacent each of the shelves and a tongue projecting outwardly from each end of the shelves. The tongues extend through the respective slot in the side panels and are folded against an outer surface of the respective side panel and shelf supports extend between adjacent shelves. The shelf supports comprises a pole located at each of the outer front corners of the shelves, opposite ends of the poles are seated in openings in respective top and bottom surfaces of the shelves. A graphics header extends above the shelves and side panels.

A further aspect of the invention is directed to a disassembled kit having components of a display rack for supporting and displaying product at a point of sale. The disassembled kit comprises a pair of side panels each having an outer surface and an inner surface facing an opposite side panel wherein the side panels made of multi-ply sheets of recyclable fiber-based material laminated together. A back panel is attached to the side panels by interfitting tabs and notches along adjacent edges of the back panel and the side panels. A plurality of shelves extend between and supported at their opposite ends on the side panels by mechanical interlocking engaged between the shelves and the side panels. The mechanical interlocking comprises a slot formed through the side panels adjacent each of the shelves and a tongue projecting outwardly from each end of the shelves. The tongues extend through the respective slot in the side panels and being folded against an outer surface of the respective side panel. The shelves are made of multi-ply sheets of recyclable fiber-based material laminated together. A graphics header extends above the shelves and side panels wherein the pair of side panels, the back wall, the plurality of shelves, and the graphics header are attached to one another to form the display rack.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein:

FIGS. 38, 39 and 40 are perspective views of the structural components of the rack of FIG. 37, wherein FIG. 38 shows the back panel and opposite side panels, FIG. 39 is a top perspective view of one of the shelves, and FIG. 40 is a bottom perspective view of one of the shelves.

DETAILED DESCRIPTION OF THE INVENTION

Figure 1:
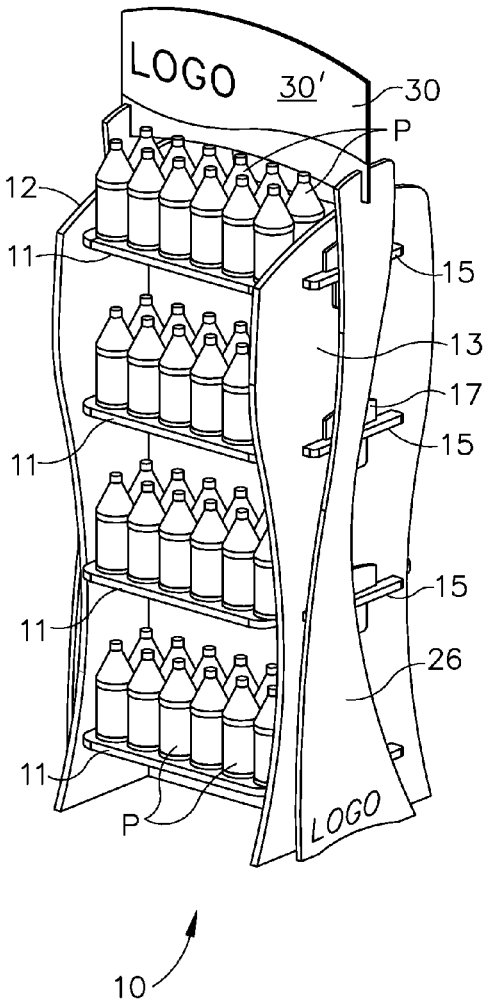
FIG. 1 is a front perspective view of a first preferred form of display rack according to the invention.
Figure 2:
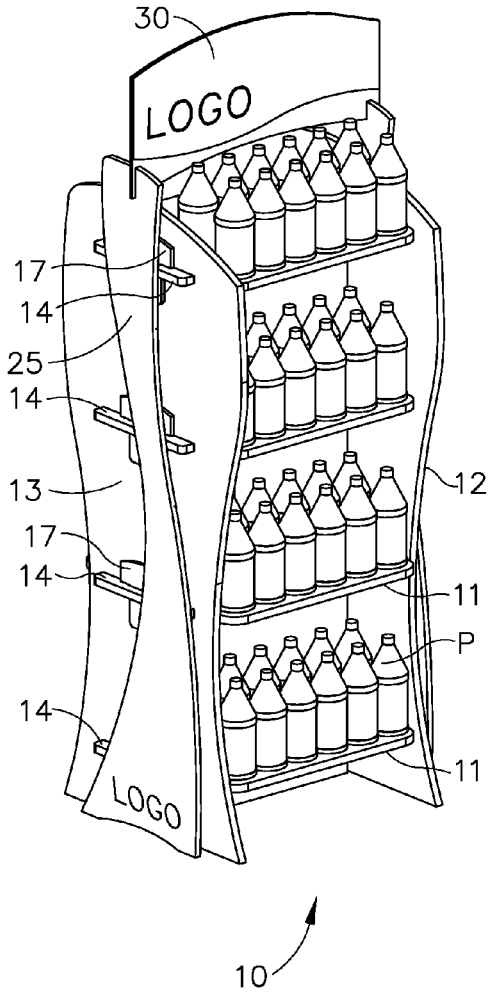
FIG. 2 is a rear perspective view of the display rack of FIG. 1.
Figure 3:
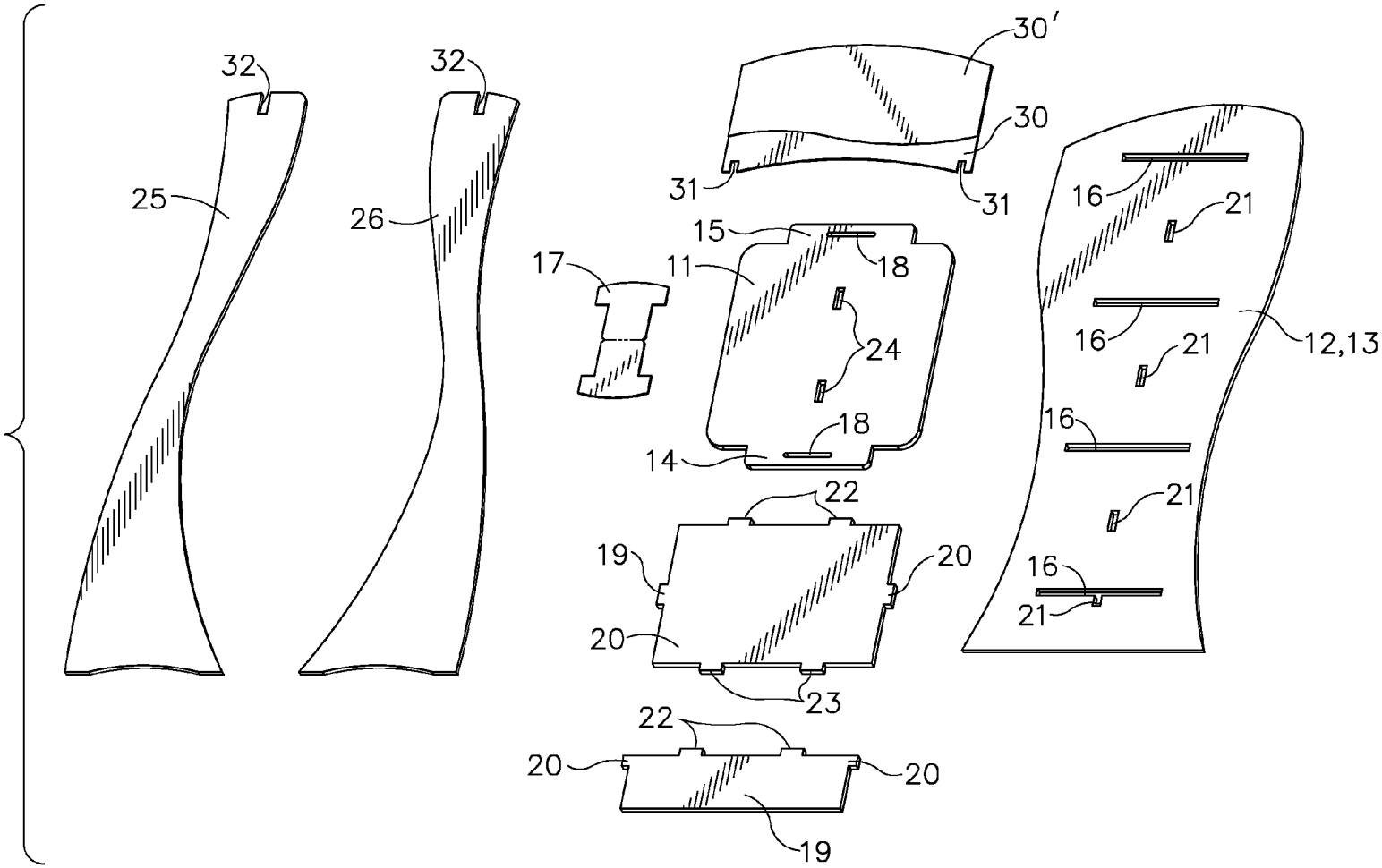
FIG. 3 is an exploded plan view of the major components of the display rack of FIG. 1.

A first preferred form of display rack according to the invention is indicated generally at 10 in FIGS. 1 and 2. In this form of the invention a plurality of shelves 11 are supported on opposed side panels 12 and 13 so that product P supported on the shelves is displayed and is accessible at both the front and the back of the rack. In the particular embodiment shown, the rack is designed for two-liter bottles but it should be understood that other products could be supported and displayed on the rack. Tabs 14 and 15 on opposite ends of the shelves are received through slots 16 in the side panels, and locking pins 17 are inserted through openings 18 in the projecting end portions of the tabs to secure them in the slots. See FIG. 30.

As seen best in FIGS. 23-25 and 31, center shelf supports 19 extend from one side panel to the other and are engaged between the shelves along their longitudinal centerline. A bottom shelf support 19' of reduced height relative to the center supports 19 extends beneath the bottom shelf. First tabs 20 on the ends of the shelf supports engage in slots 21 in the side panels, and second tabs 22 and 23 on the top and bottom edges of the center supports engage in slots 24 in the shelves. The bottom shelf support 19' has tabs 22 only on its top edge.

Graphics panels 25 and 26 having tongues 27 and 28 on the inner surface thereof adjacent the top and bottom ends are attached to the outside faces of each side panel by engagement of the tongues in the openings 18 in the projecting end portions of the tabs 14 and 15 on the ends of the top and bottom shelves. See FIGS. 18-20 and 32-35.

A header 30 with graphics 30' is supported on the top ends of the graphics panels 25 and 26 by engagement of notches 31 in the bottom edge of the header adjacent its opposite ends with notches 32 in the top ends of the graphics panels 25 and 26.

Figure 6:
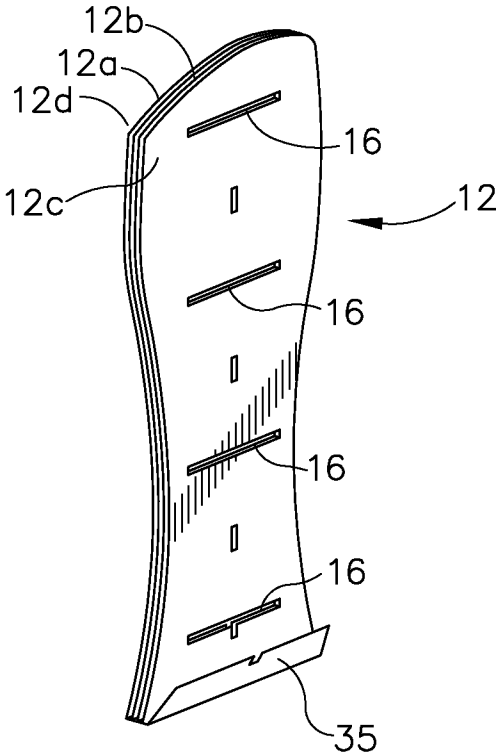
FIG. 6 is a slightly exaggerated perspective view of a completed side panel used in the display rack of FIG. 1, looking toward the inner surface of the side panel and showing how the flange at the bottom edge of the second blank wraps around the bottom edges of the laminated first blanks.
Figure 5:
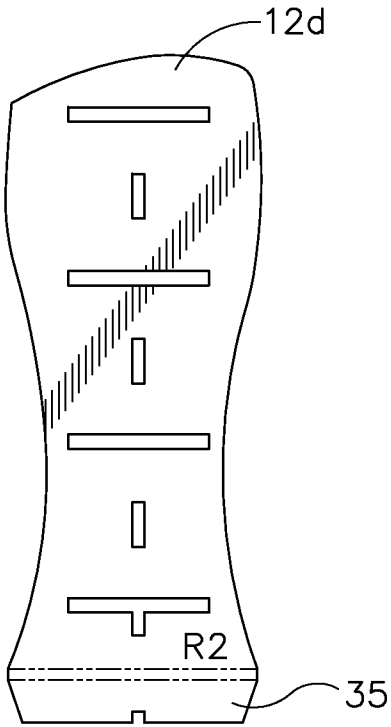
FIG. 5 is a plan view of a second side panel blank that is laminated with three of the blanks of FIG. 4 to form one of the side panels of the display rack of FIG. 1.
Figure 4:
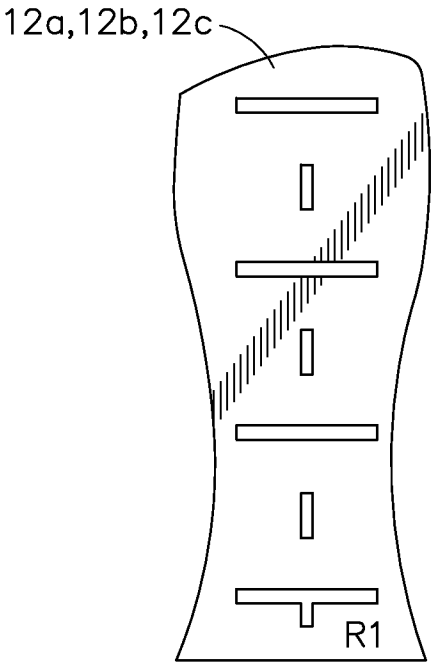
FIG. 4 is a plan view of a first side panel blank that is laminated with two additional identical blanks to form a portion of one of the side panels of the display rack of FIG. 1.
Figure 7:
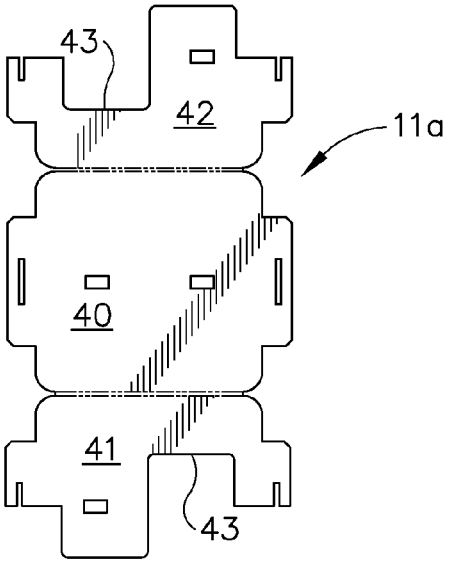
FIG. 7 is a plan view of a blank used in making an inner portion or core of a shelf as used in the display rack of FIG. 1.
Figure 8:
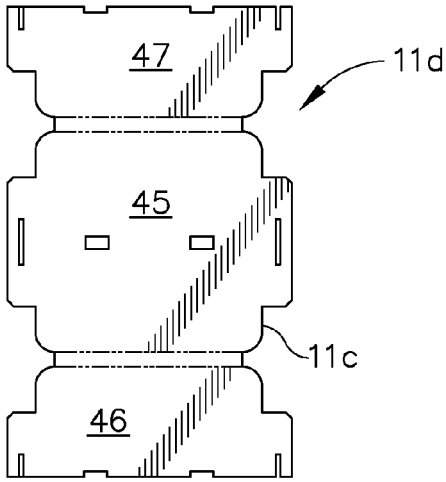
FIG. 8 is a plan view of a blank used in making an outer wrap for the shelf used in the rack of FIG. 1.

As seen best in FIGS. 4-6, in the particular construction illustrated and described herein, each side panel 12 and 13 is comprised of three blanks or sheets 12*a*, 12*b* and 12*c* of 51-C-KRAFT/33 laminated together, and a single blank or sheet 12*d* of 51-C-KRAFT/33 laminated to the sheets 12*a*-12*c*. In the present invention, 51 C Kraft is the type of paper used to make the combined corrugated board which is a Kraft back liner, 51 refers to the Edge Crush Test (ECT) value, and 33 is the lbs of the paper used in the medium or middle liner to make the combine corrugated board. The sheet 12*d* forms the outer surface of the side panel in an assembled rack and has a flange 35 on its bottom end that is wrapped around the bottom ends of the laminated sheets 12*a*-12*c*.

As seen best in FIGS. 7-10, the shelves 11 each comprise an inner piece or shelf core 11*a* made up of two blanks or sheets 11*b* and 11*c* laminated together, and an outer wrap 11*d* formed from a single blank or sheet 11*e* folded around and laminated to the inner piece.

Figure 9:
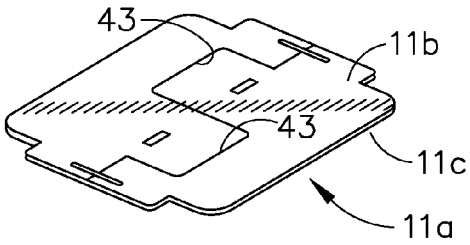
FIG. 9 is a perspective view of two of the blanks of FIG. 7 folded into operative position and laminated together to form a shelf core.

The sheets 11*b*, 11*c* that are laminated together to form the shelf core each comprise a center panel 40 having length and width dimensions corresponding to the length and width dimensions of a finished shelf, and half panels 41 and 42 foldably joined to the front and back edges thereof, respectively. The outer edges of the half panels have offset cutouts 43 therein so that when the half panels are folded inwardly over the center panel they fit together along a generally zigzag line. This arrangement improves the bending strength of the core 11*a* when the two folded sheets 11*b*, 11*c* are laminated together to form the core as shown in FIG. 9. In the particular construction shown and described herein, the sheets 11*b*, 11*c* are formed of 51-BC-KRAFT/33

Figure 10:
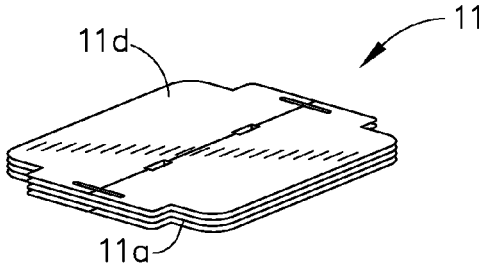
FIG. 10 is a perspective view of a completed shelf, wherein the wrap of FIG. 8 is applied to the core of FIG. 9.
Figure 11:
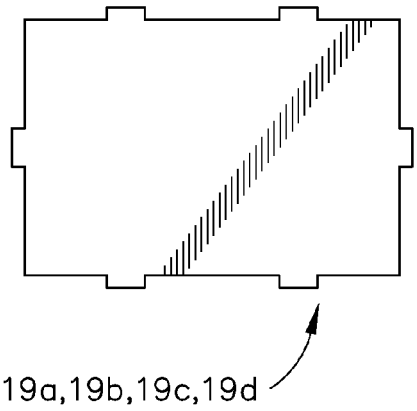
FIG. 11 is a plan view of a blank used in making a center brace for the shelves in the rack of FIG. 1.

The sheet 11*e* that forms the wrap 11*d* comprises a center panel 45 having length and width dimensions corresponding to the length and width dimensions of the panel 40 of the core piece, and half panels 46 and 47 foldably joined to the front and back edges of the center panel. The center panel 45 of the wrap is overlaid with the center panel 40 of the core, and the half panels 46 and 47 folded inwardly and laminated to the core to form a finished shelf 11 as seen in FIG. 10. In the particular construction shown and described herein, the sheet 11*e* that forms the wrap is formed of 40-C-KRAFT.

Figure 12:
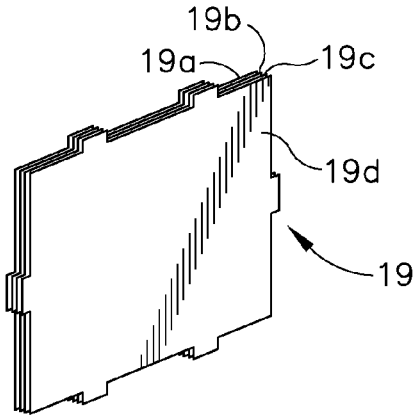
FIG. 12 is a perspective view of a completed center brace, shown slightly exaggerated, wherein four of the blanks of FIG. 11 are laminated together.
Figure 13:
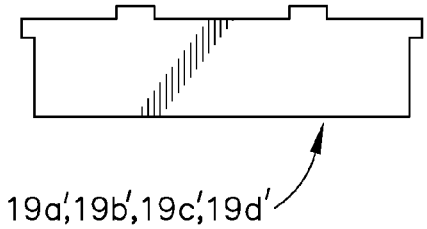
FIG. 13 is a plan view of a blank used in making a center brace for the bottom shelf in the display rack of FIG. 1.
Figure 14:
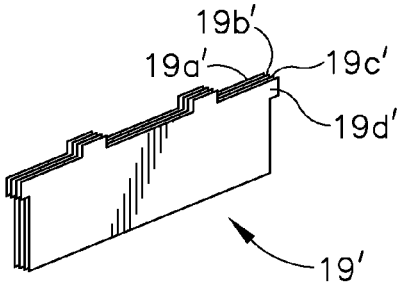
FIG. 14 is a perspective view of a completed bottom center brace, shown slightly exaggerated, wherein four of the blanks of FIG. 13 are laminated together.

The center shelf supports 19 are each formed of four blanks or sheets 19*a*-19*d* of 51-BC-KRAFT laminated together as shown in FIG. 12, and the bottom shelf support 19' is formed of four blanks or sheets 19*a*'-19*d*' of 51-BC-KRAFT laminated together as shown in FIG. 14.

Figure 15:
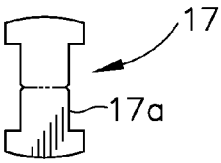
FIG. 15 is an enlarged plan view of a blank used to make one of the locking pins for securing the tabs on the shelves in place in the slots in the side panels.
Figure 30:
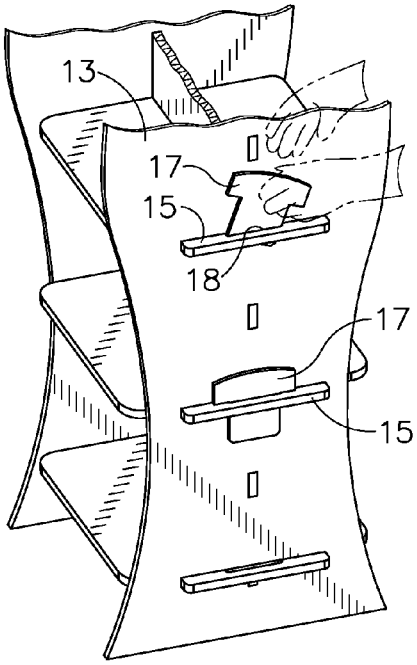
FIG. 30 is a fragmentary perspective view showing the locking pins being inserted into the openings in the ends of the tabs projecting through the slots in the side panels.

The locking pins 17 are each formed of a single sheet 17A of 40-C-KRAFT, shown in FIG. 15, which is folded onto itself to form the generally T-shaped locking pin for insertion into the openings 18 in the tabs 14 and 15 as depicted in FIG. 30.

Figure 16:
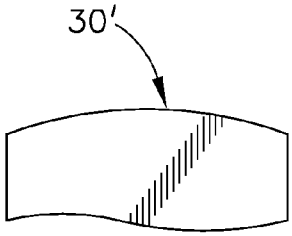
FIG. 16 is a plan view of a graphic for application to the header of FIG. 17.
Figure 17:
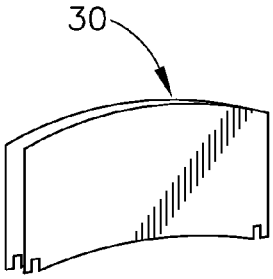
FIG. 17 is a plan view of a header panel for application to the display rack of FIG. 1.
Figure 18:
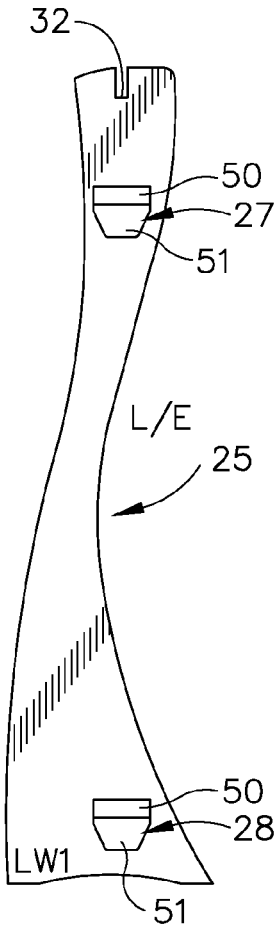
FIG. 18 is a plan view of a first component of a graphics panel for application to the side panels of the rack of FIG. 1.
Figure 19:
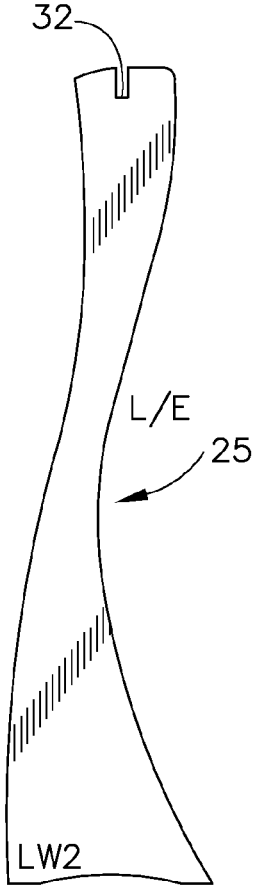
FIG. 19 is a plan view of a second component of the graphics panel for application to the side panels of the rack of FIG. 1.
Figure 20:
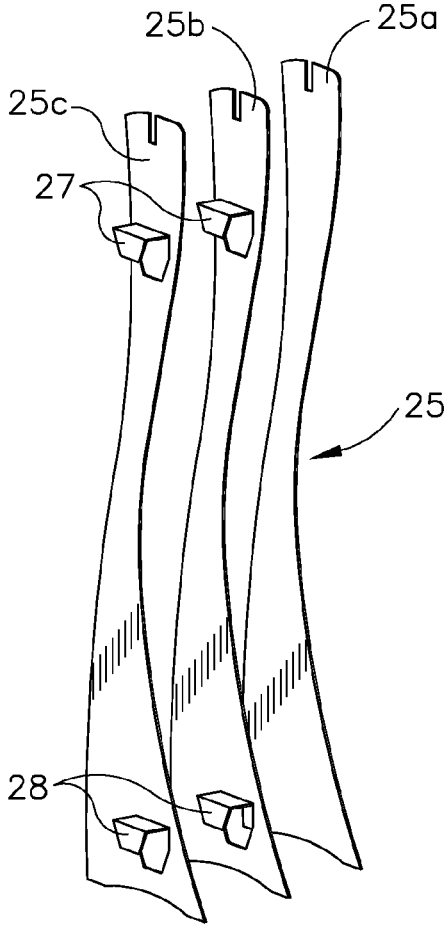
FIG. 20 is an exploded perspective view, on a reduced scale, showing how two of the graphics panel components of FIG. 18 are laminated with the graphics panel component of FIG. 19 to form a completed side graphics panel as used in the rack of FIG. 1.

The header 30 is formed of two sheets of 51-BC-KRAFT laminated together, as depicted in FIG. 17. Graphics panels 30', shown in FIG. 16, are glued to the front and back surfaces of the header by the manufacturer prior to shipment of the rack to a point of use. In the particular construction described and illustrated herein, the graphics panels 30' are made of 51-BC-MWOS (i.e., Model White Out Side).

The graphics panels 25 and 26 are identically constructed and only panel 25 will be described in detail. Panel 25 comprises three sheets 25*a*, 25*b* and 25*c* laminated together. Sheet 25*a*, which forms an unbroken outer surface of the panel when it is installed, is made of 51-BC-MWOS, and sheets 25*b* and 25*c* are made of 51-BC-KRAFT. Each of sheets 25*b* and 25*c* is formed with the tongues 27 and 28 adjacent its top and bottom ends, but when the graphics panel is installed on the rack only the tongues on the innermost sheet 25*c* are folded into operative position and inserted into the openings 18 in the projecting end portions of the tabs 14 and 15 on the ends of the top and bottom shelves as depicted in FIGS. 32-35. It will be noted that the tongues have a first portion 50 foldably connected to the respective panel, and a second portion 51 foldably connected to the first portion. The first portion has a width the same as the width of the tab 14 or 15 between the opening 18 and the outer edge of the tab, thereby permitting the tongue to be folded inwardly and downwardly against the tab with the second portion extended through the opening 18. After the tongues have been inserted into the openings 18, locking pins 17 are then inserted through the openings 18 behind the portions 51 of the tongues.

Figure 21:
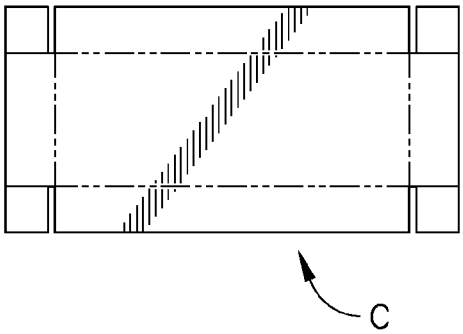
FIG. 21 is a plan view of a blank for making either the top or the bottom of a container for use in shipping the components of the rack of the invention.
Figure 22:
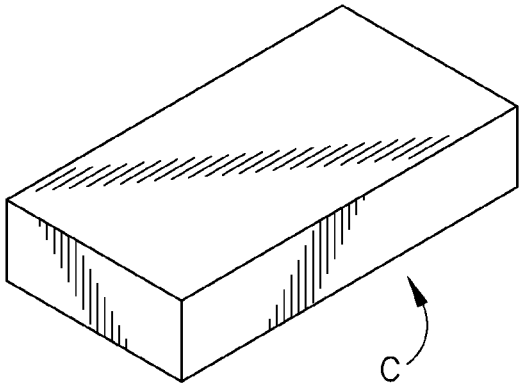
FIG. 22 is a perspective view of a completed package for shipping the disassembled rack of the invention.

The display rack 10 is shipped to a point of sale in disassembled kit form in a compact package comprising the components of the rack in a shipping container C as illustrated in FIG. 22. The container C comprises a top tray adapted to fit over a bottom tray, both of rectangular construction and in the particular example described herein made of 40-C-KRAFT. A blank for making one of the trays is shown in FIG. 21, it being understood that the blank for making the other tray is identical except for having a slightly different size so that one of the trays will fit within the other to form the container shown in FIG. 22.

Figure 23:
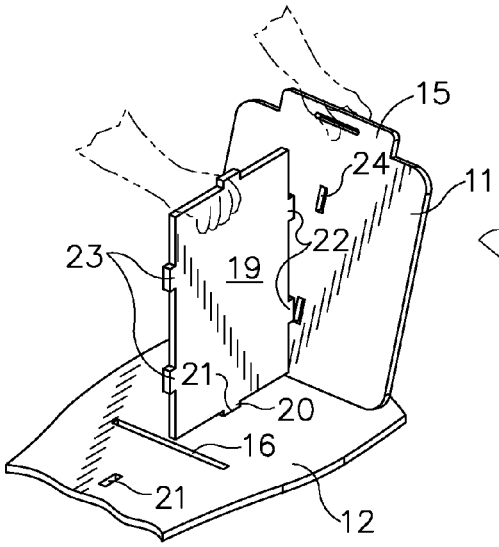
FIG. 23 is a fragmentary perspective view showing one of the shelves of FIG. 10 in position as the top shelf on a first side panel of FIG. 6, with a center brace of FIG. 12 being moved into operative position.
Figure 24:
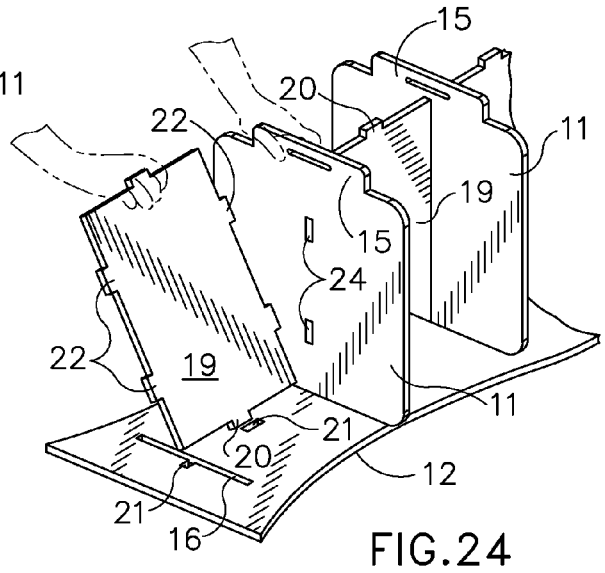
FIG. 24 is a fragmentary perspective view showing two additional shelves in position on the first side panel and a subsequent center brace being positioned.
Figure 25:
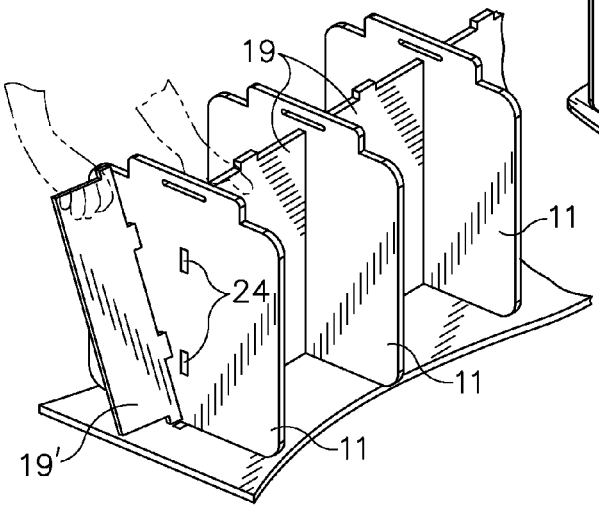
FIG. 25 is a fragmentary perspective view showing a bottom shelf in position and the bottom center brace being positioned.
Figure 26:
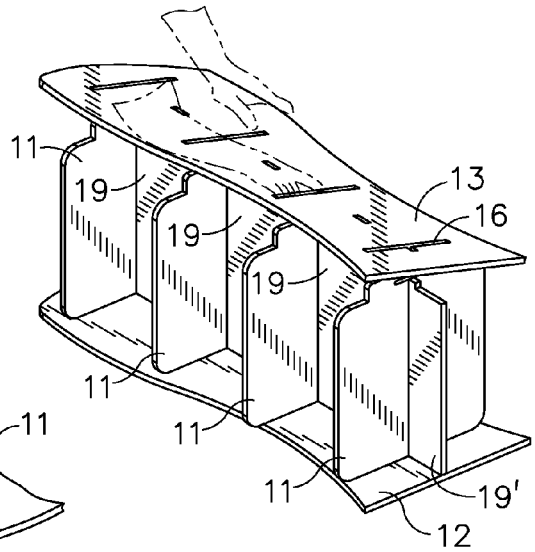
FIG. 26 is a fragmentary perspective view showing the second side panel being positioned on the shelves and center braces previously applied to the first side panel.
Figure 27:
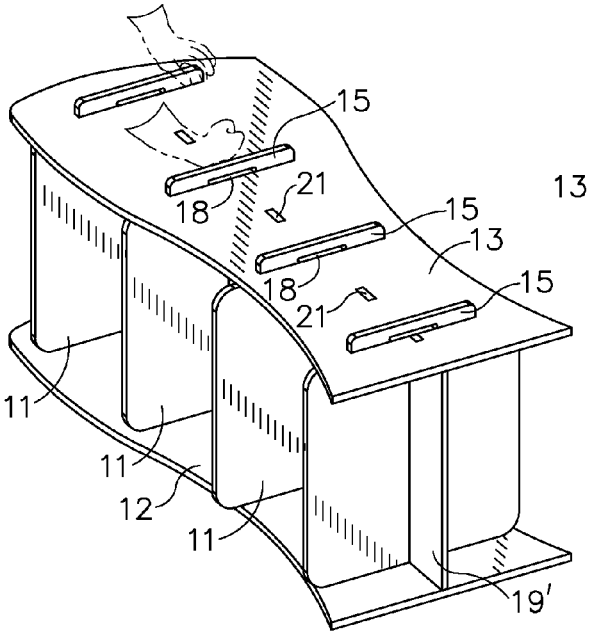
FIGS. 27-29 are fragmentary perspective views depicting the side panels being fully engaged on the tabs projecting from the ends of the shelves.
Figure 28:
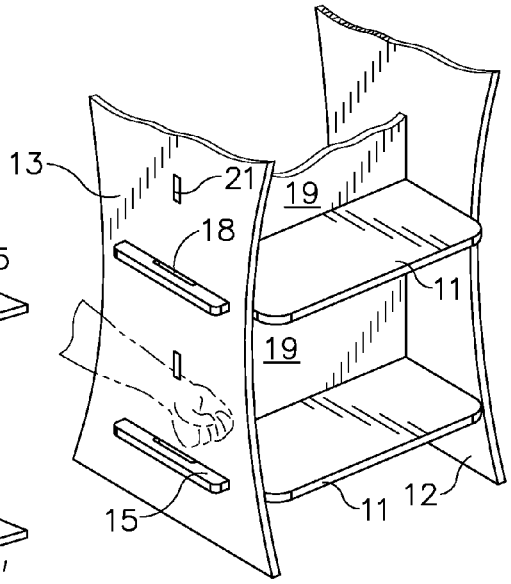
Figure 29:
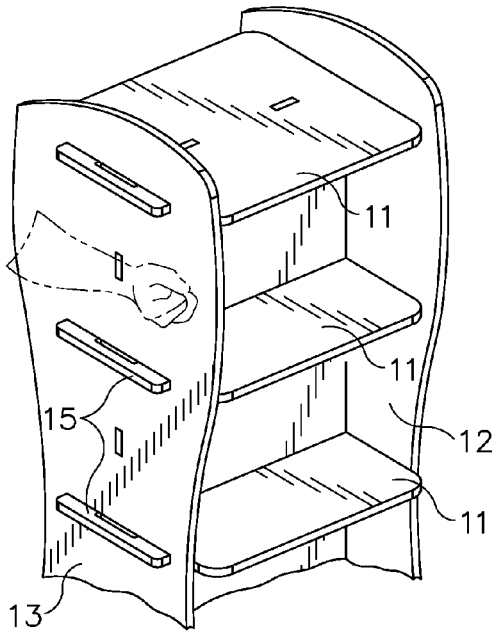
Figure 31:
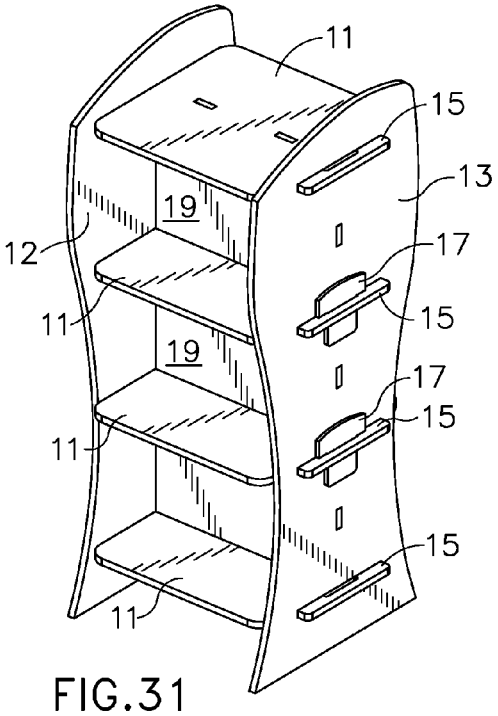
FIG. 31 is a perspective view of the rack of FIG. 1 with all the structural components fully assembled but prior to application of the graphics panels of FIG. 20.
Figure 32:
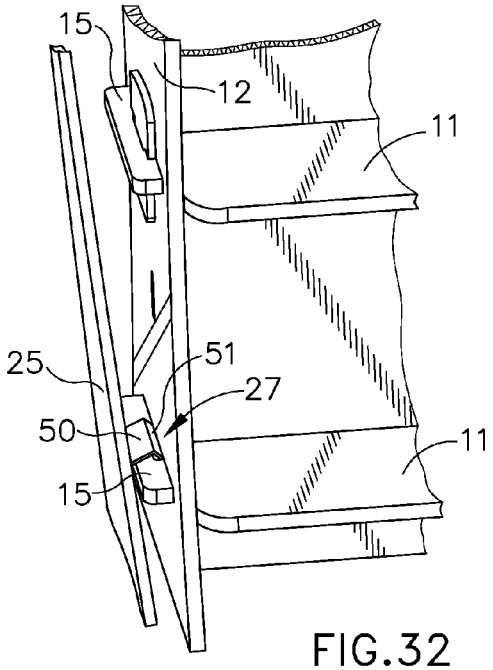
FIG. 32 is an enlarged fragmentary perspective view depicting the locking tongue at the bottom end of one of the graphics panels being inserted into the opening in the projecting tab of the bottom shelf.
Figure 33:
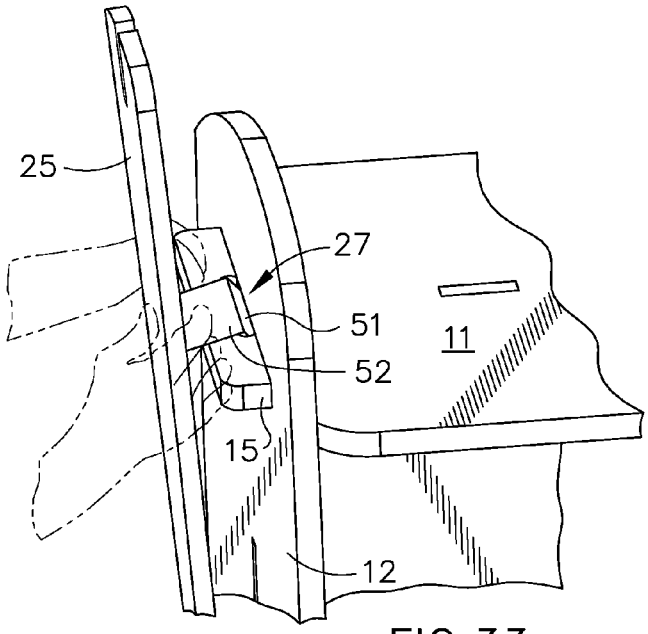
FIG. 33 is an enlarged fragmentary perspective view depicting the locking tongue at the top end of the graphics panel being inserted into the opening in the projecting tab of the top shelf.
Figure 34:
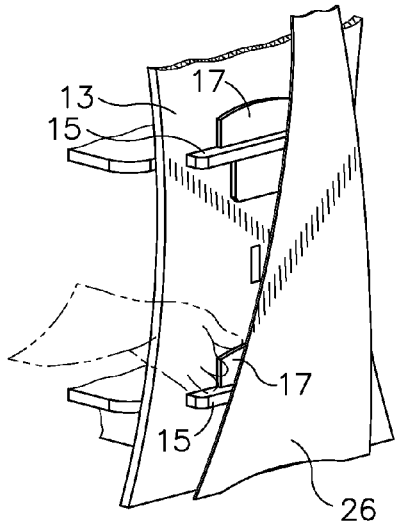
FIG. 34 is an enlarged fragmentary perspective view depicting a locking pin being inserted into the tab opening behind the previously inserted tongue at the bottom end of the graphics panel.
Figure 35:
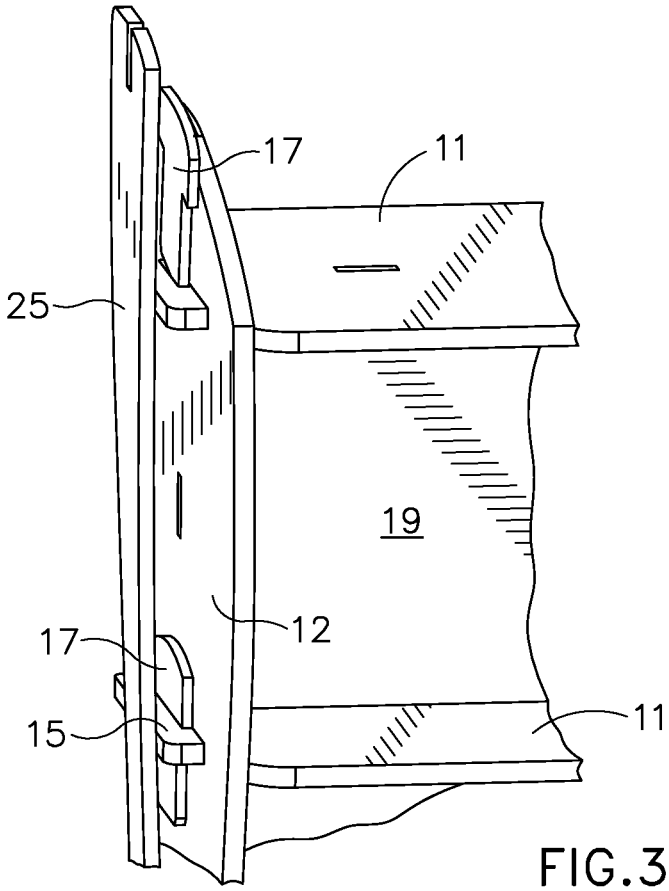
FIG. 35 is an enlarged fragmentary perspective view depicting a locking pin being inserted into the tab opening behind the previously inserted tongue at the top end of the graphics panel.
Figure 36:
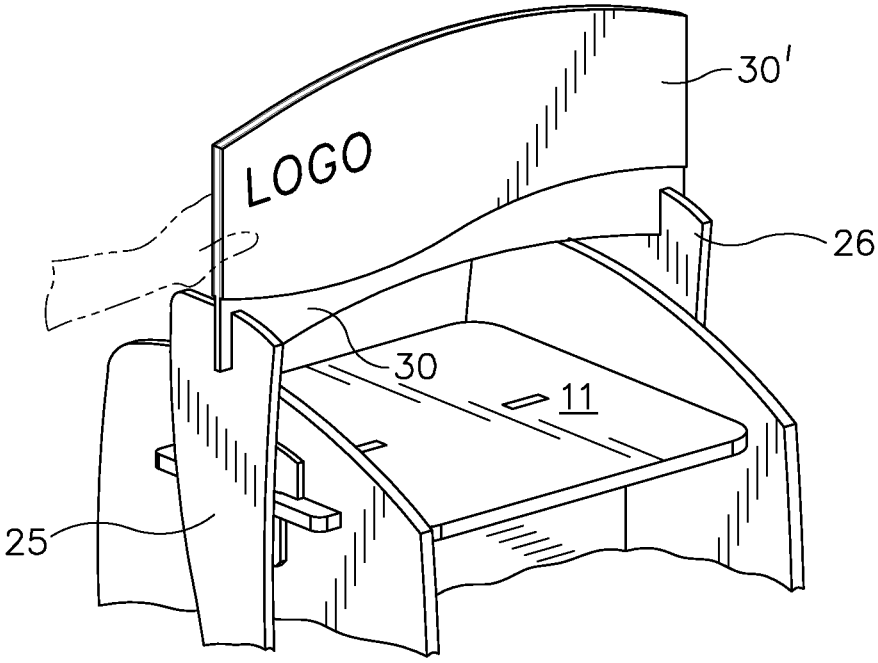
FIG. 36 is a fragmentary perspective view depicting the header being applied to the upper ends of the side graphics panels, thus completing the assembly of the display rack of FIG. 1.

The steps of assembling the rack 10 are illustrated in sequence in FIGS. 23-36, and when considered in conjunction with the remaining disclosures herein are believed to be self-explanatory. Briefly, FIGS. 23-25 show the steps of assembling the shelves 11 and shelf supports 19 and 19' to each other and to one of the side panels 12. FIGS. 26-29 show the steps of assembling the second side panel 13 to the previously assembled shelves and shelf supports. FIG. 30 shows one of the locking pins 17 being inserted into the opening 18 of the projecting end of a tab 14 or 15. FIG. 31 shows an assembled rack ready for attachment of the side and header graphics panels. FIGS. 32-35 show the steps of attaching a side graphics panel 25 or 26, and FIG. 36 shows the step of attaching the graphics header 30 to the previously attached side graphics.

Figure 37:
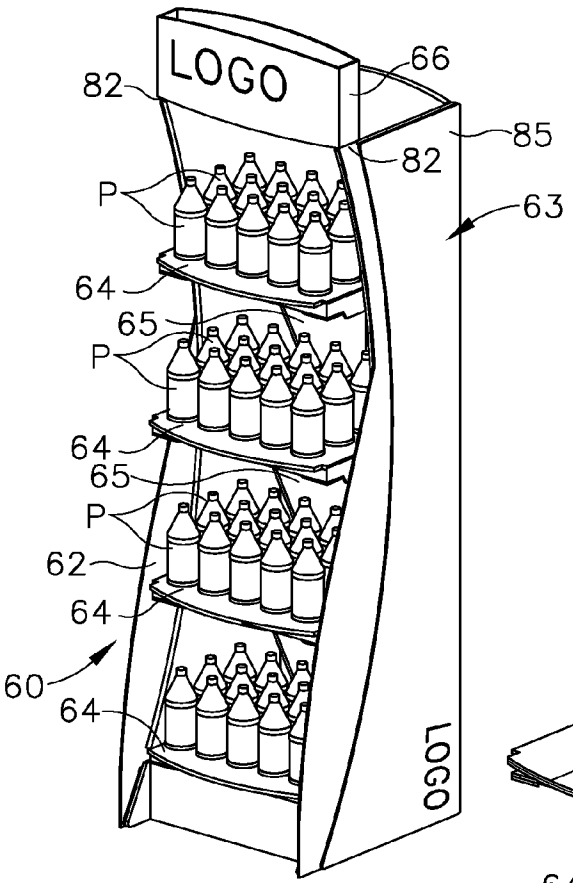
FIG. 37 is a front perspective view of a second preferred form of display rack according to the invention, wherein the rack includes a back panel and opposite side panels, with the shelves supported on the back panel and side panels.
Figure 43:
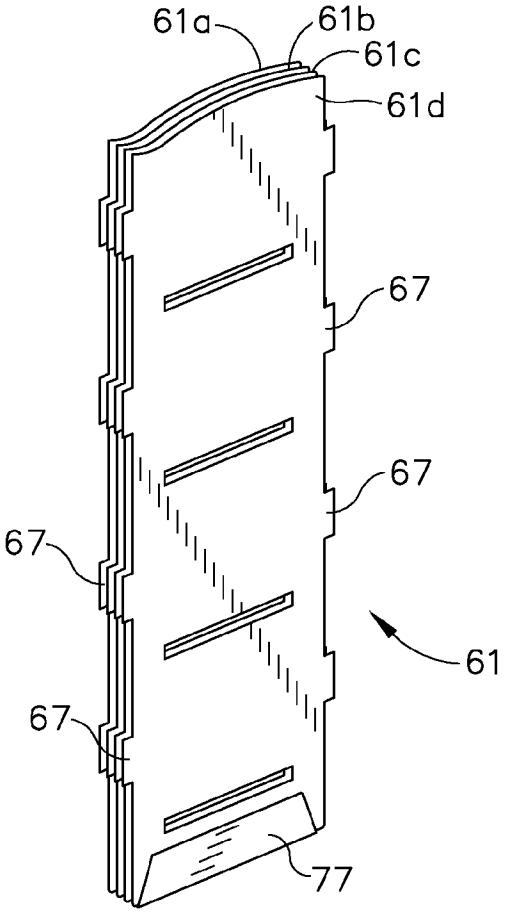
FIG. 43 is a perspective view, shown somewhat exaggerated, of three of the blanks of FIG. 41 laminated with one of the blanks of FIG. 42 to form a back panel.
Figure 42:
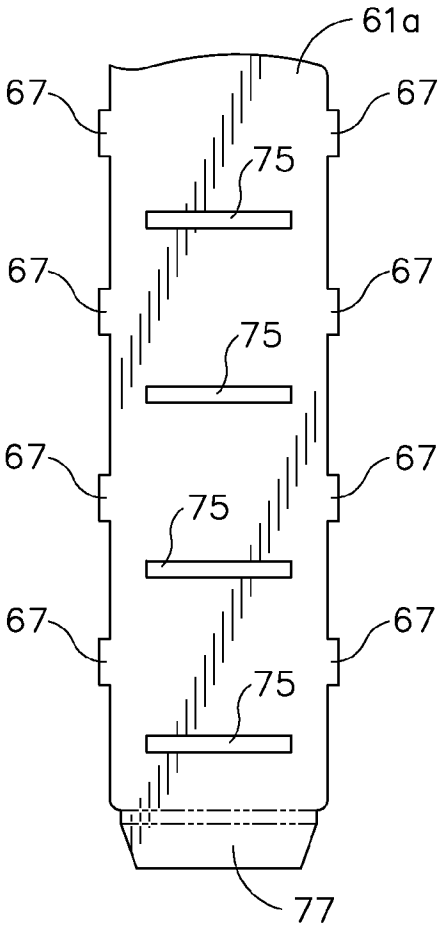
FIG. 42 is a plan view of a second blank for use in making the back panel of the rack of FIG. 37.
Figure 41:
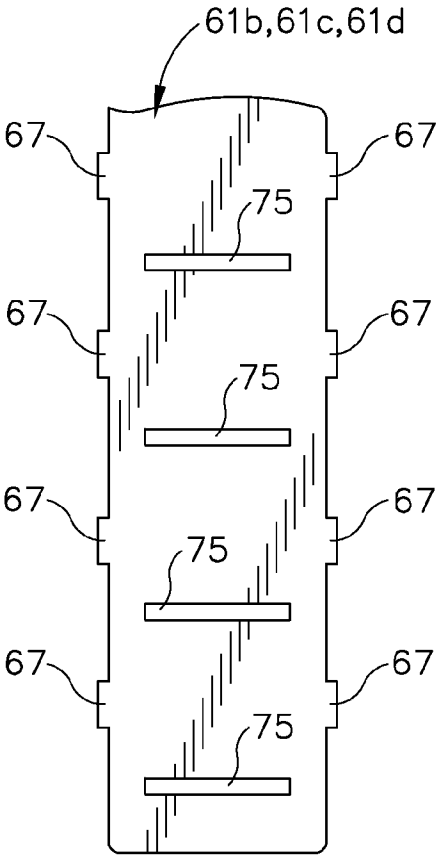
FIG. 41 is a plan view of a first blank for use in making the back panel of the rack of FIG. 37.
Figure 47:
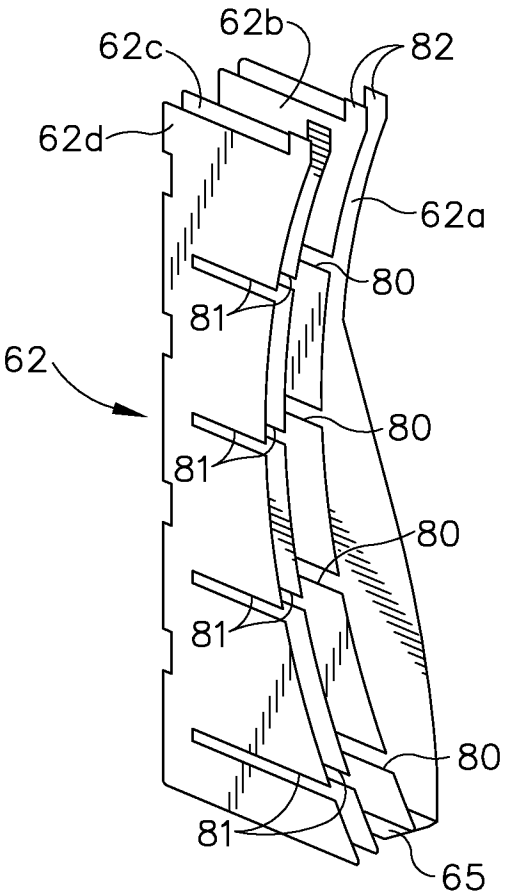
FIG. 47 is an exploded perspective view showing how the blanks of FIGS. 44-46 are laminated together to make a side panel.
Figure 46:
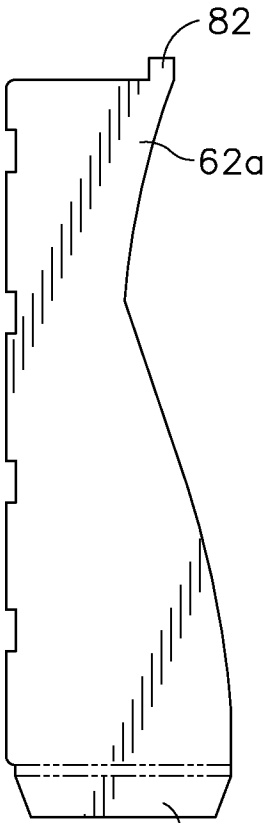
FIG. 46 is a plan view of a third blank for use in making a side panel of the rack of FIG. 37.
Figure 45:
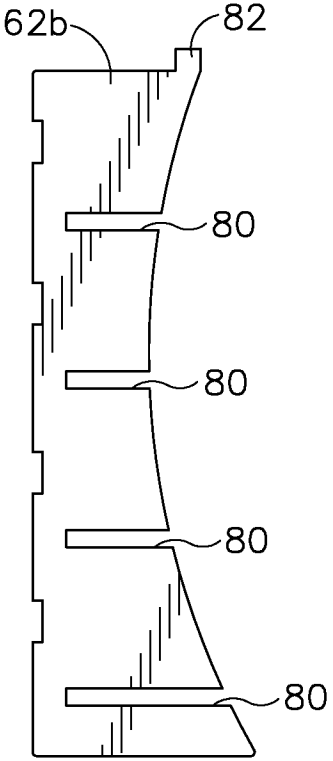
FIG. 45 is a plan view of a second blank for use in making a side panel of the rack of FIG. 37.
Figure 44:
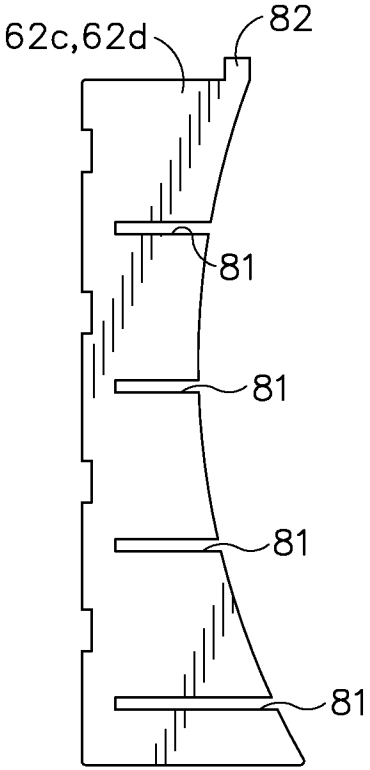
FIG. 44 is a plan view of a first blank for use in making a side panel of the rack of FIG. 37.

A second preferred form of display rack according to the invention is indicated generally at 60 in FIG. 37. The rack 60 has a back panel 61 mechanically interlocked with side panels 62 and 63, and shelves 64 are supported by the side panels and the back panel. Generally triangularly shaped shelf supports 65 are engaged between the shelves, and a graphics header 66 is attached to upper ends of the side panels. The side panels also contain graphics.

The mechanical interlock between the back panel 61 and the side panels 62 and 63 comprises a plurality of generally equally spaced tabs 67 and 68 projecting from opposite side edges of the back panel and engaged in notches 70 along the back edge of the respective side panels.

Each side panel has a plurality of spaced parallel channels 72 formed on its inner surface, extending at one end through the front edge of the panel but terminating at its opposite end spaced from the back edge of the panel. Depending flanges 73, 74 on the opposite side edges of the shelves are received in the channels to support the shelves on the side panels.

A plurality of spaced parallel slots 75 are formed through the back panel, spaced closer to the bottom end of the panel than to its top end, and a tab 76 projecting from the rearward edge of each shelf 64 is received through a respective slot. The ends of the tabs projecting through the slots each has an opening 18 therethrough, and a locking pin 17 is inserted into the opening 18 to pin the shelves to the back panel in the same manner that the shelves in the first embodiment are pinned to the side panels.

Figure 63:
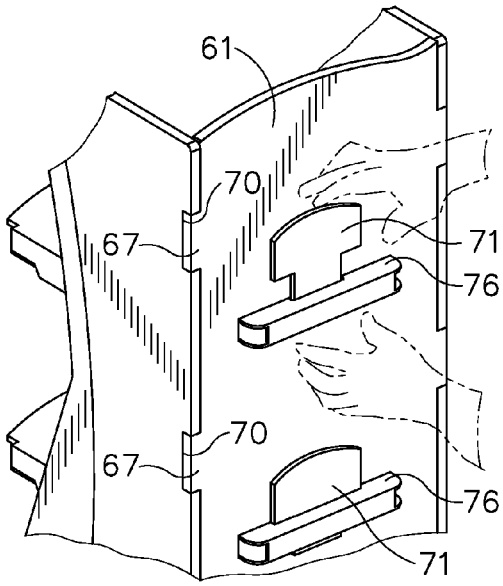
FIG. 63 is a fragmentary rear perspective view showing one of the locking pins being inserted into the opening in one of the shelf tabs.

The back panel 61 is comprised of four blanks or sheets 61*a*-61*d* of 51-BC-KRAFT laminated together, with one of the sheets 61*a* forming an outer surface of the back panel in an assembled rack. The sheet 61*a* has a flange 77 on its bottom end that is folded around the bottom ends of the other three sheets, as shown in FIG. 63.

The side panels 62 and 63 are identically constructed and only one panel 62 will be described in detail. The panel 62 is comprised of four blanks or sheets 62*a*-62*d* of 51-BC-KRAFT laminated together. Sheet 62*a* has a convexly curved forward edge portion and a flange 65 on its bottom end that is folded around the bottom ends of sheets 62*b*-62*d*. Sheet 62*a* forms an outer surface of the side panel when it is installed in a rack. Parallel spaced slots 80 extend into sheet 62*b* through the forward edge thereof, terminating short of the rearward edge of the sheet, and parallel spaced slots 81 extend into sheets 62*c* and 62*d* through the forward edges thereof. The slots 80 and 81 are in registry with one another, but slots 81 are narrower than slots 80, whereby the slots form the channels 72. See FIGS. 58 and 59. The sheets 62*b*-62*d* have concavely curved forward edges. Small tabs 82 extend upwardly from the front corners of each of the sheets.

Figure 48:
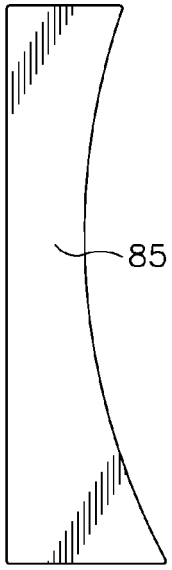
FIG. 48 is a plan view of a graphic for application to the side panels of the rack of FIG. 37.
Figure 49:
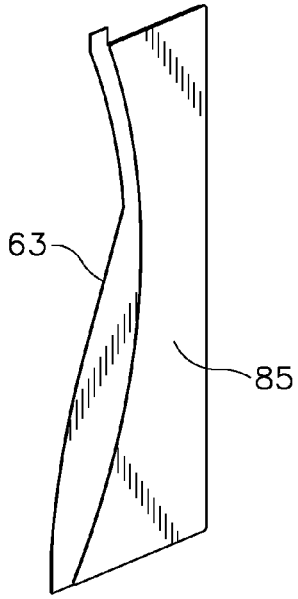
FIG. 49 is a perspective view of a side panel with the graphic of FIG. 48 applied to it.

A side graphics panel 85 made of 51-BC-MWOS is applied to the outer surface of each of the side panels 62 and 63. See FIGS. 37, 48 and 49.

Figure 50:
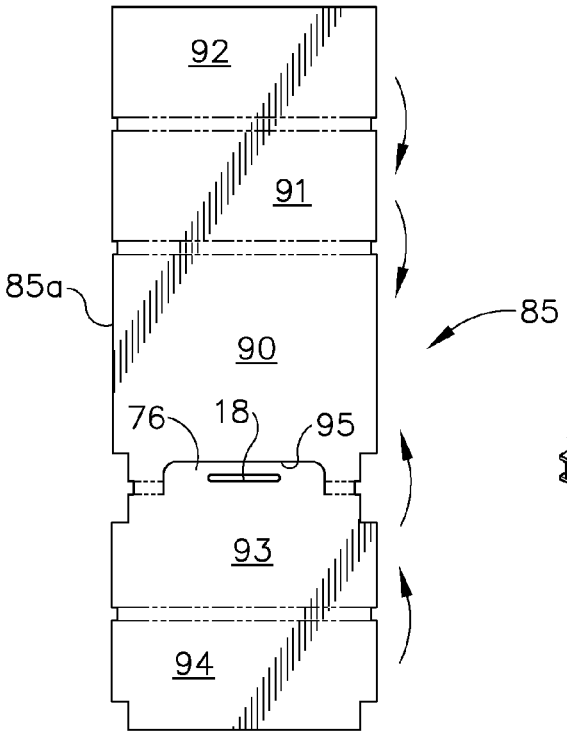
FIG. 50 is a plan view of a blank for making an inner component or core of one of the shelves used in the rack of FIG. 37.
Figure 51:
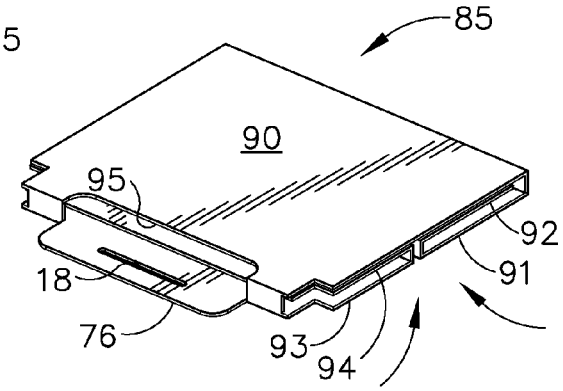
FIG. 51 is a perspective view of an inner shelf component folded from the blank of FIG. 50.

The shelves 64 comprise an inner piece or core 85 and an outer wrap 86. As seen in FIGS. 50 and 51, the core 85 is formed from a blank or sheet 85*a* having a center panel 90 of substantially the same length and width as a finished shelf, with a first half panel 91 folded to an edge of the center panel that corresponds to the forward edge of the shelf, a second half panel 92 folded to the first half panel, a third half panel 93 folded to the edge of the center panel opposite the first half panel and which forms the rearward edge of the shelf, and a fourth half panel 94 folded to the third half panel. A cut 95 is made in the edge of the center panel adjacent the third half panel and when the panels are folded into the configuration shown in FIG. 51, the material separated from the center panel by the cut forms a part of the tab 76 projecting from the rear of the shelf when the sheet is folded to form the shelf. In the particular example disclosed herein, the sheet 85*a* comprises 51-BC-KRAFT.

Figure 52:
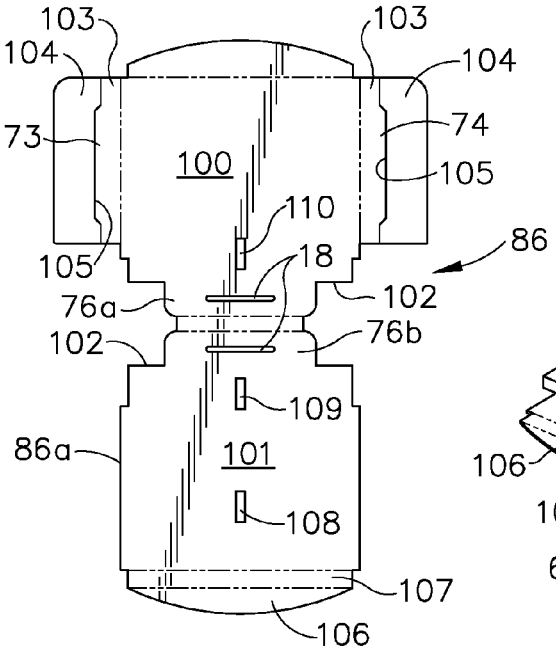
FIG. 52 is a plan view of a blank for making an outer wrap component for a shelf used in the rack of FIG. 37.

As seen in FIG. 52, the wrap 86 is formed from a sheet 86*a* having first and second panels 100, 101, which form the top and bottom surfaces, respectively, in a completed shelf. The panels 100 and 101 are foldably joined along adjacent edges and each has substantially the same outline as a shelf 64.

Figure 40:
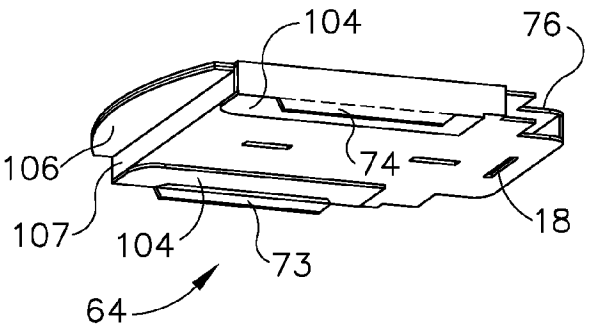
Figure 53:
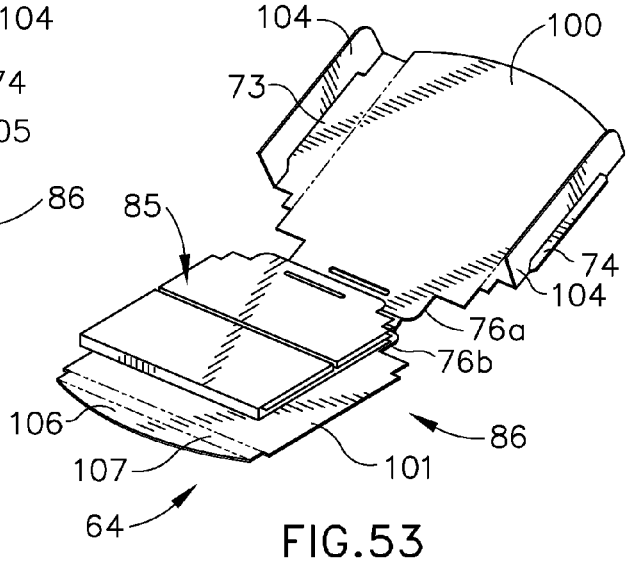
FIG. 53 is an exploded perspective view depicting how the outer wrap of FIG. 52 is applied to the inner component of FIG. 51.

Cutouts 102 in the sides of the sheet at the folded connection between the panels form extensions 76*a*, 76*b* that comprise part of a tab 76 in the completed shelf. First flaps 103 are foldably connected to opposite side edges of panel 100, and second flaps 104 are foldably connected to the outer edges of the first flaps. A shaped cut 105 extends along most of the length of the fold between the first and second flaps. When the wrap 86 is folded around the core 85 and the flaps 103 and 104 are folded downwardly as depicted in FIG. 53, the flaps 103 extend downwardly from opposite side edges of the shelf to form the flanges 73, 74. The second flaps 104 are glued to the bottom of the panel 101. The outer end edges of the panels 100, 101 are outwardly curved, and the curved edge 106 on panel 101 is joined to the panel along a narrow panel 107, whereby when the wrap is in operatively folded relationship around the core 85, the panel 107 extends upwardly at an angle and the curved edge 106 is glued to the underside of the curved edge on panel 100 to form an outwardly curved lip on the shelf. See FIG. 40. A pair of small slots 108 and 109 is formed in the panel 101 near its rearward and forward edges, and a small slot 110 is formed in panel 100 near its rearward edge, for a purpose described hereinafter. In the particular example disclosed herein, the sheet 86*a* comprises 55-C-KRAFT.

Figure 54:
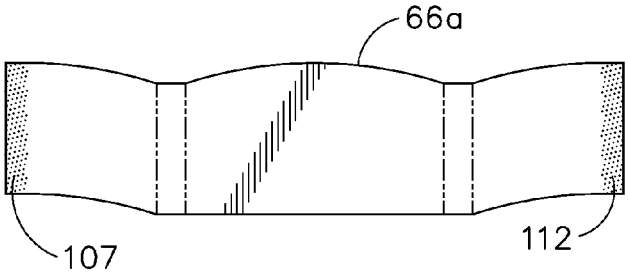
FIG. 54 is a plan view of a blank for making a graphic panel for application to the top of the rack of FIG. 37.
Figure 54A:
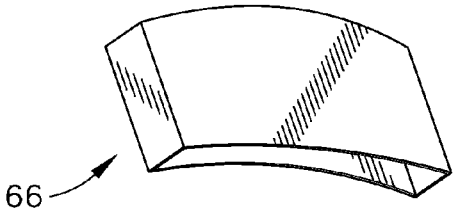

FIG. 54 shows a blank or sheet 66*a* that is folded to make the header 66. Adhesive is applied in the shaded areas 111, 112 at opposite ends of the sheet, and these areas are adhered together when the sheet is folded to form the generally tubular shape shown in FIG. 54A. In the particular example disclosed herein, the header 66 is made of 32-E-KRAFT.

Figure 55:
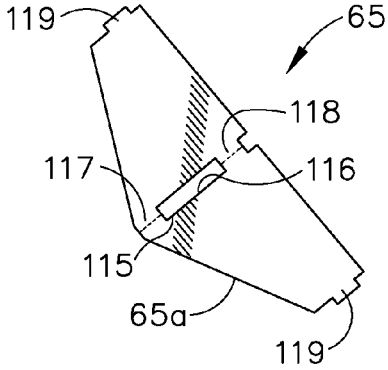
FIG. 55 is a plan view of a blank for making a shelf center brace for use in the rack of FIG. 37.
Figure 55A:
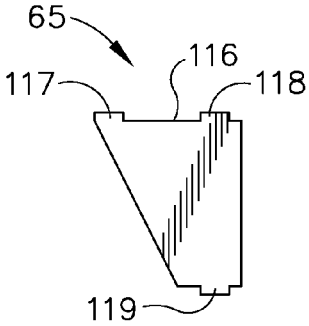
Figure 64:
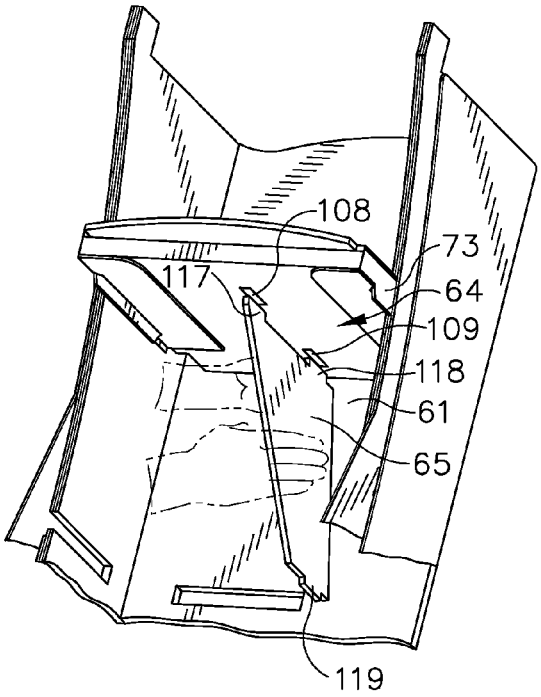
FIG. 64 is a fragmentary perspective view showing one of the center braces being placed in operative position.

As shown in FIGS. 55 and 55A, the triangularly shaped shelf supports 65 are made from a blank or sheet 65*a* that is folded on itself along a fold 115 to form a double thickness. A narrow slot 116 is cut out along the fold 115 so that when the sheet is folded in half two small tabs 117 and 118 are formed along the edge. A small tab 119 also is on the narrow edge of the support. When the shelf support is installed, as shown in FIG. 64, the tab 119 on the bottom edge of the support is engaged in slot 110 in the top of the subjacent shelf, and the tabs 117, 118 are engaged in the slots 108, 109, respectively, in the bottom of the superjacent shelf. In the particular example disclosed herein, the shelf supports are made of 51-BC-KRAFT.

Figure 56:
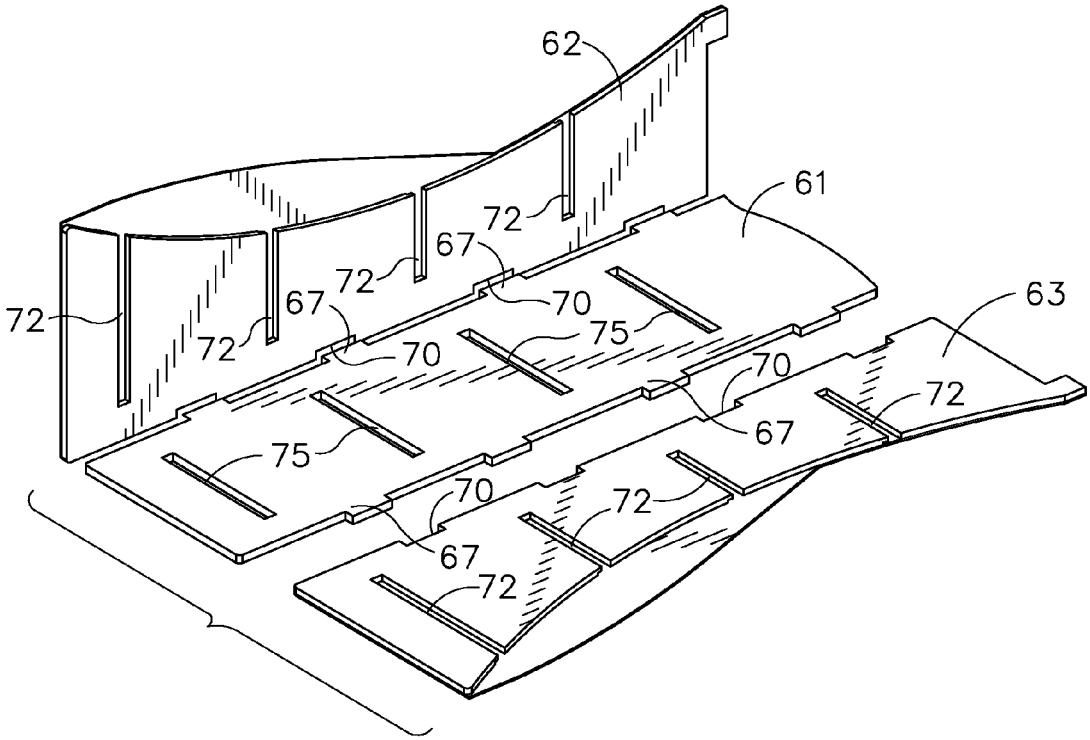
FIG. 56 is a fragmentary perspective view showing how the side panels are attached to the back panel by engaging the notches and tabs along adjacent side edges.
Figure 57:
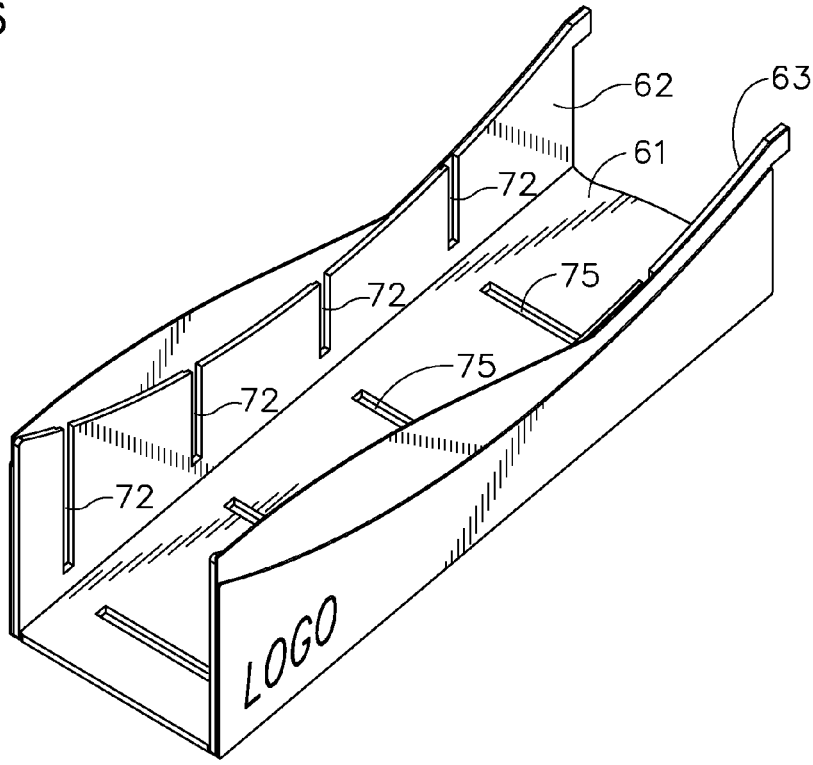
FIG. 57 is a perspective view of the assembled back panel and side panels, with the partially assembled rack lying on its back.
Figure 58:
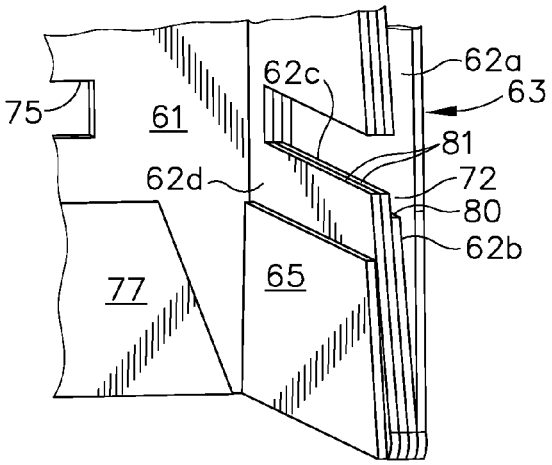
FIG. 58 is a greatly enlarged fragmentary view looking toward the front edge of the bottom end of one of the side panels, showing the front-to-back channel formed by the laminated blanks of FIGS. 44-46.
Figure 59:
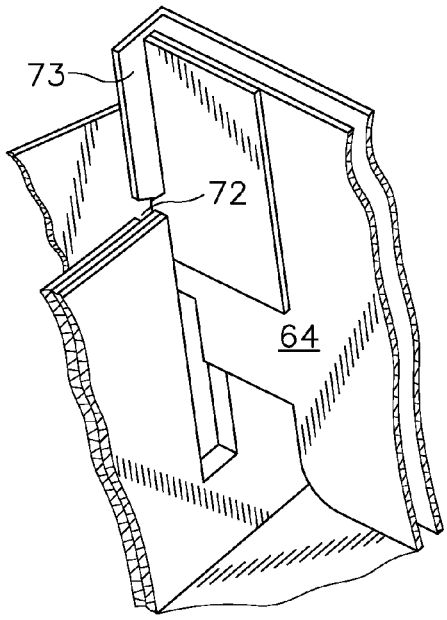
FIG. 59 is a fragmentary bottom perspective view showing how the flange depending from one side edge of a shelf is inserted into a channel in a side panel.
Figure 60:
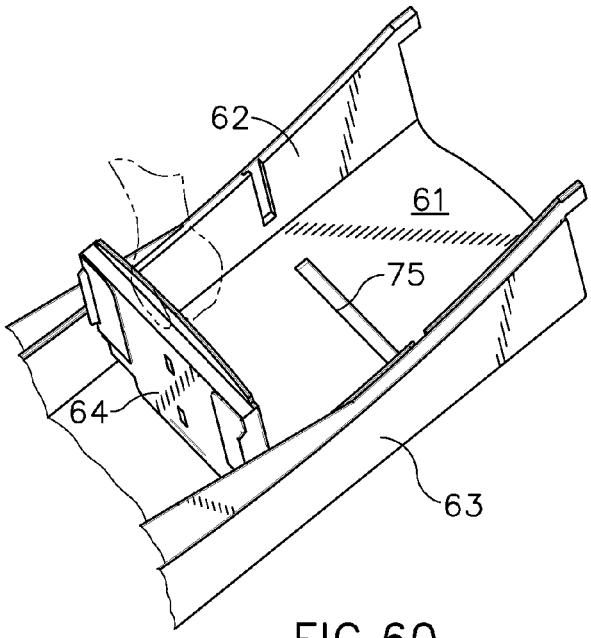
FIGS. 60 and 61 are fragmentary perspective views depicting a shelf being slid into position between the side panels.
Figure 61:
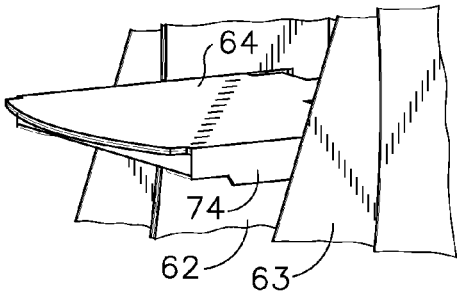
Figure 62:
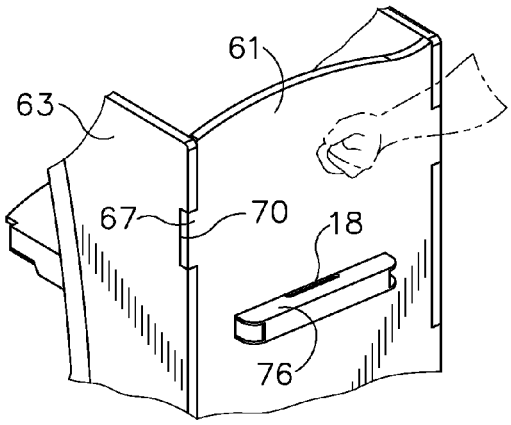
FIG. 62 is a fragmentary perspective view looking toward the rear of the rack of FIG. 37, depicting the back being firmly pressed into place to ensure firm engagement of the tabs and notches along the side edges and full insertion of the tabs into the slots.
Figure 65:
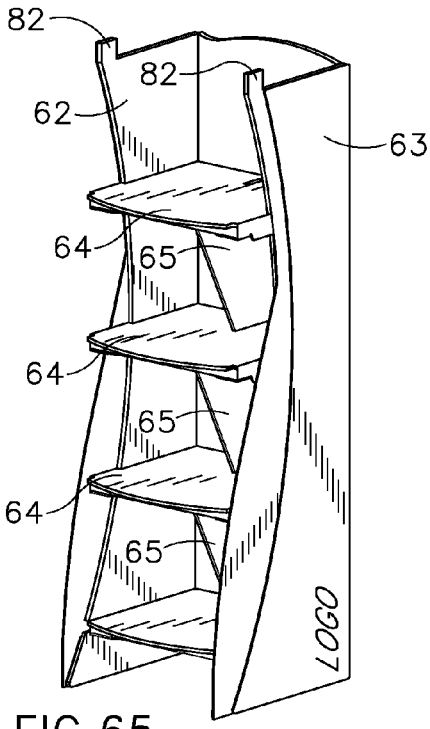
FIG. 65 is a front perspective view of the rack of FIG. 37 prior to the graphics header being applied.
Figure 66:
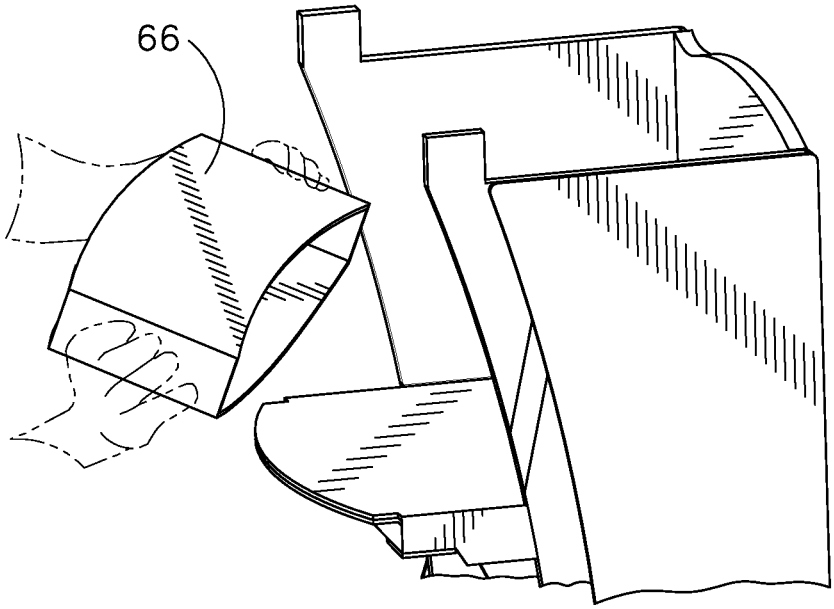
FIG. 66 is a fragmentary perspective view showing the header graphics panel being readied for installation on top of the rack.
Figure 67:
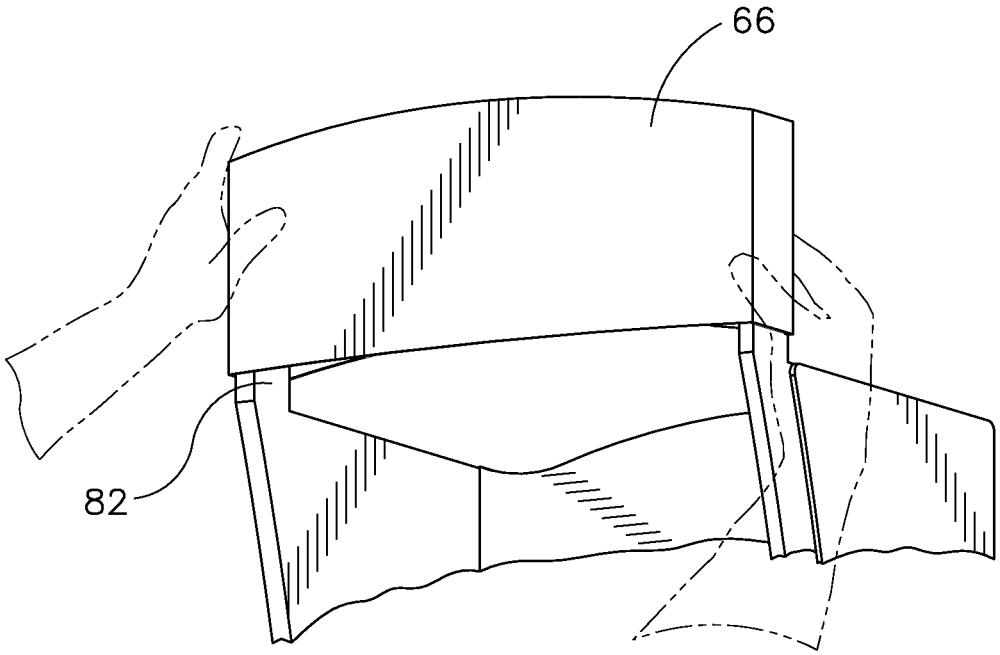
FIG. 67 is a fragmentary perspective view showing the header graphics being applied to the rack.

The steps for assembling the rack 60 are illustrated in FIGS. 56-67 and are believed to be self-explanatory. Briefly, FIG. 56 shows the side panels 62 and 63 being assembled to the back panel 61, and FIG. 57 shows the side panels installed. FIG. 58 shows the channel 72 just above the bottom of the rack, and FIG. 59 is a view looking up under a shelf and showing how a flange 73 or 74 on the edge of the shelf is positioned to be slid into the channel. FIG. 60 illustrates a shelf in position attached to the side and back panels, and shows the slot 75 in the back panel for receiving the tab 76 on the back of a shelf to be installed. FIG. 61 shows the subsequent shelf installed. FIG. 62 shows the back panel being tapped to fully seat the tab 76 in the slot 75, and FIG. 63 shows a locking pin 17 being inserted into the opening 18 in the tab end portion that projects through the back panel. FIG. 64 shows one of the shelf supports 65 being installed with the narrow edge down, and FIG. 65 shows the assembled rack before the header is installed. FIG. 66 shows the header 66 being opened up into a generally tubular configuration and FIG. 67 shows the header being installed on the tabs 82 projecting upwardly from the front corners of the side panels.

Figure 69:
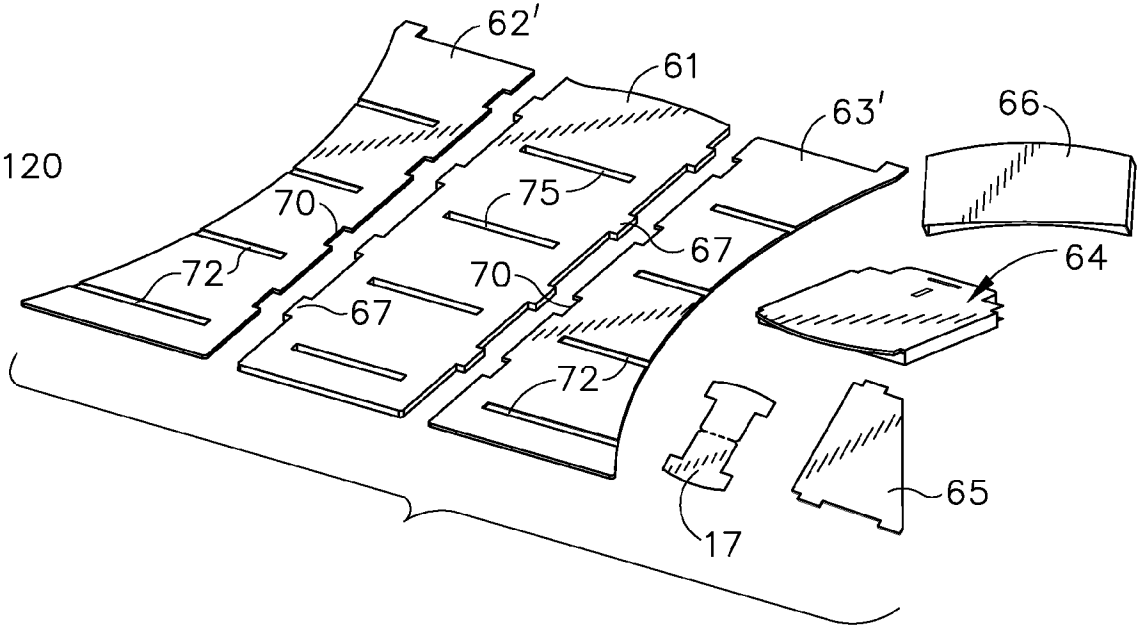
FIG. 69 is an exploded perspective view of the components of the FIG. 68 embodiment.
Figure 68:
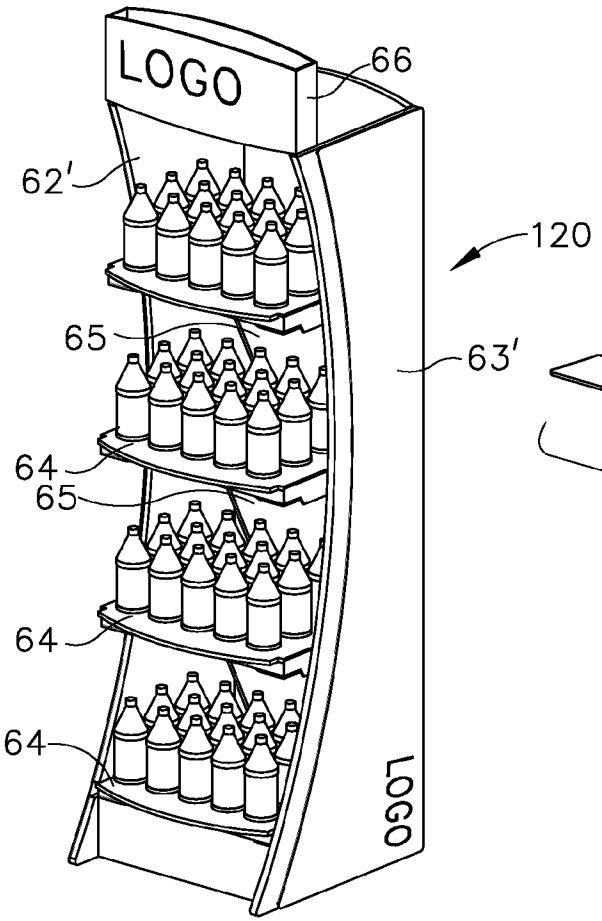
FIG. 68 is a front perspective view of a variation of the rack in FIG. 37, wherein the front edges of the side panels are convexly shaped rather than concave as in FIG. 37. In all other respects this form of the invention is the same as the FIG. 37 embodiment.

A variation of the rack 60 is shown at 120 in FIG. 68. This rack differs from rack 60 in that the front edge of the side panels 62', 63' is convexly curved over its length rather than being convexly curved over its bottom portion as in the rack 60. In all other respects the rack 120 is constructed identically to rack 60. Components for constructing the rack 120 are shown in FIG. 69, wherein parts corresponding to the parts in rack 60 are given the same reference numbers.

Figure 38:
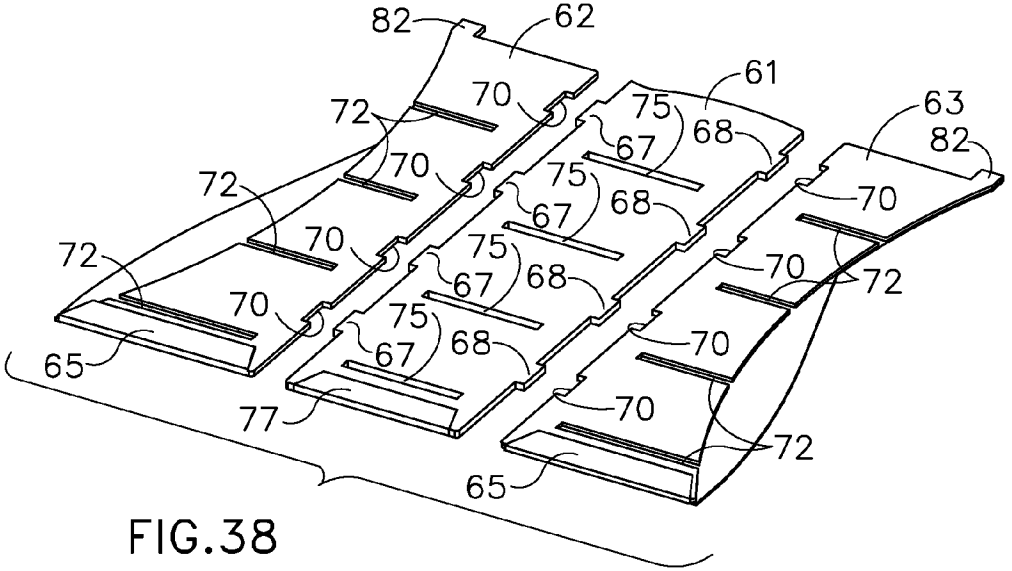
Figure 39:
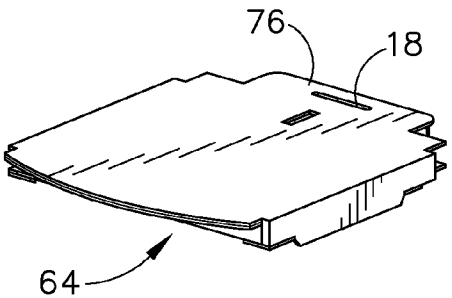
Figure 71:
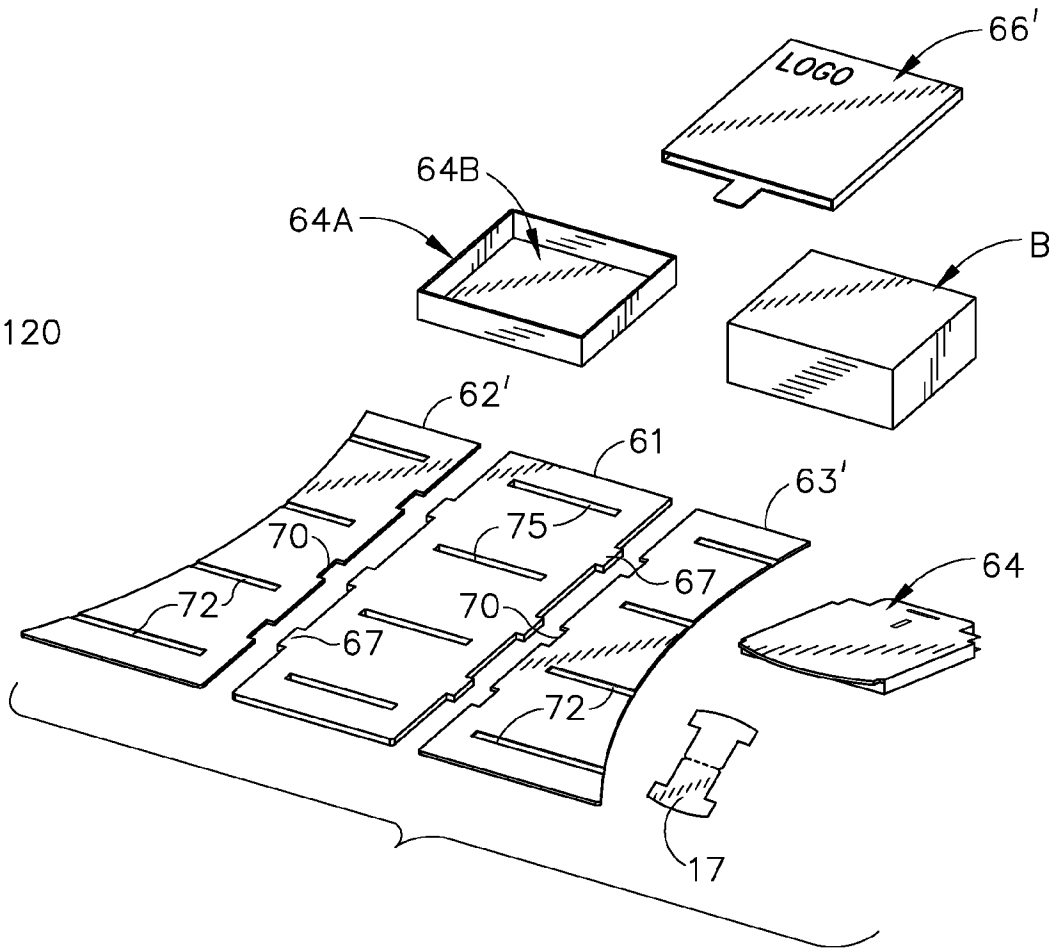
FIG. 71 is an exploded perspective view of the components of the FIG. 68 embodiment.
Figure 70:
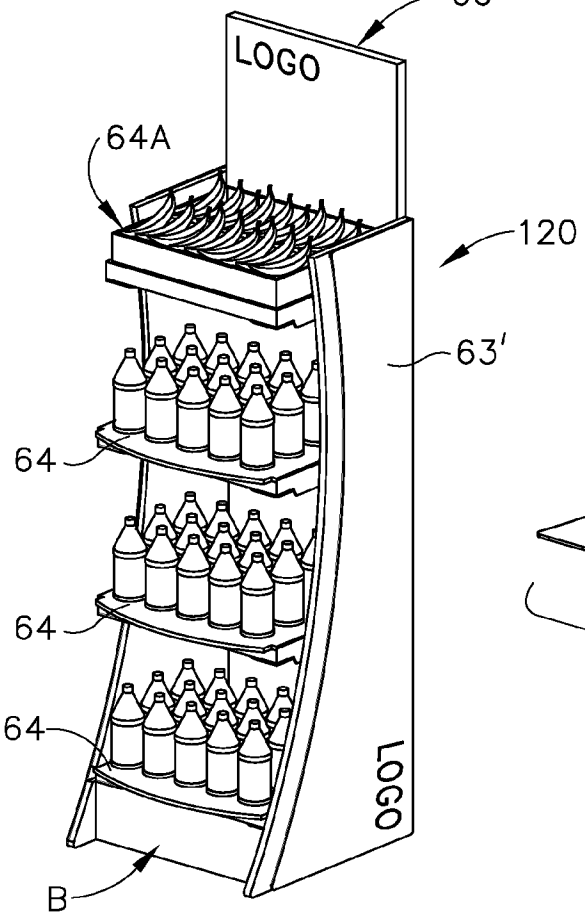
FIG. 70 is a front perspective view of alternative variation of the rack in FIGS. 37 and 38, wherein the top shelf comprises a tray so that fruits and/or vegetables or in combination with liquid bottle being disposed therein and a base is adhered to underside of the bottom shelf.
Figure 73:
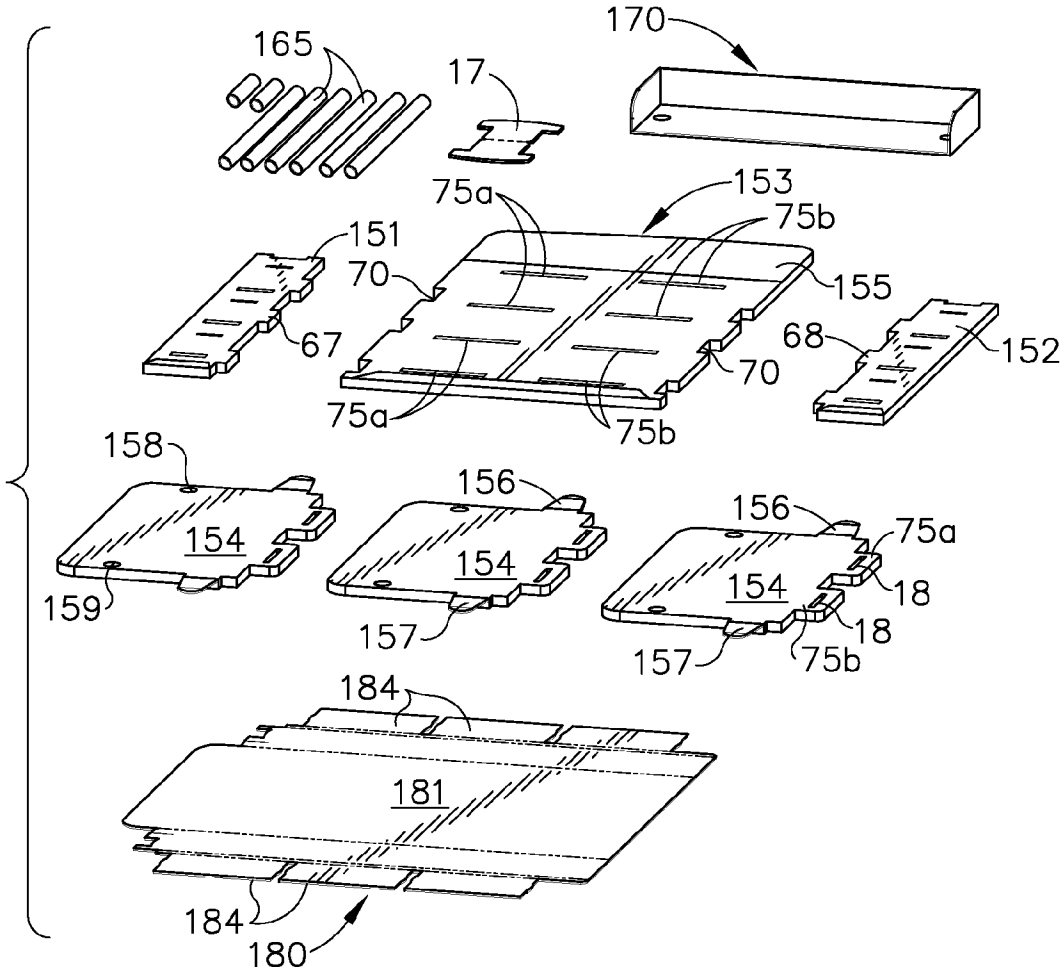
FIG. 73 is a top perspective view of the components used in the FIG. 70 embodiment.

FIG. 70 is a front perspective view of alternative variation of the rack in FIGS. 37 and 38, wherein the top shelf 64 comprises a tray 64A so that fruits and/or vegetables or in combination with liquid bottle being disposed therein and a base B is adhered to underside of the bottom shelf. The tray 64A has an interior space 64B that contains fruits such as, for example, banana or other vegetables therein. A header 66' is installed on the rack as well. It is within the scope of the present invention that a divider may be placed within the tray or the shelf so that varieties of items such as fruits, bottle of water and the likes disposed therein. The rack in FIG. 70 is assembled from components depicted in FIG. 71.

Figure 72:
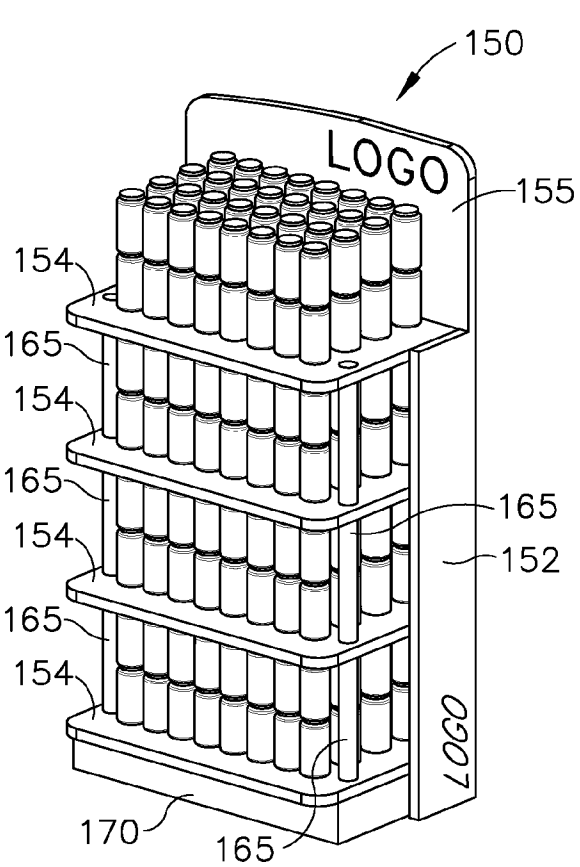
FIG. 72 is a front perspective view of a third preferred form of the invention, wherein the shelves are supported on back and side panels, and support posts extend between adjacent shelves adjacent the outer front corners thereof.
Figure 77:
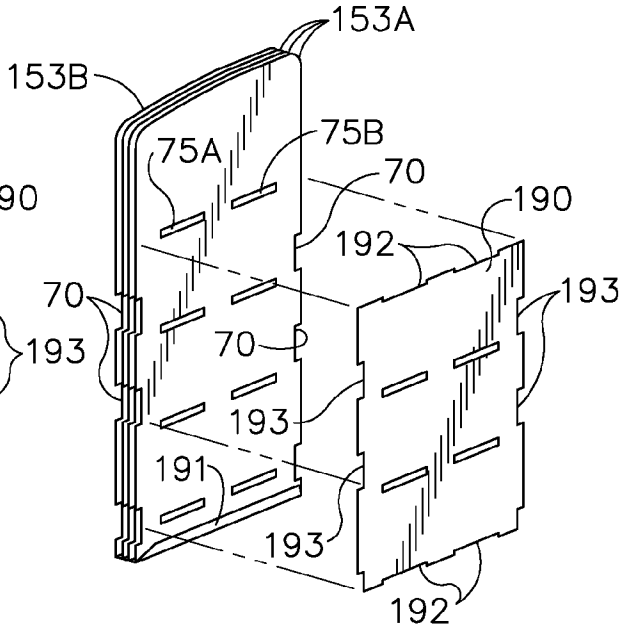
FIG. 77 is an exploded perspective view showing how the blanks of FIGS. 74-76 are laminated together.

A third preferred form of display rack according to the invention is shown at 150 in FIG. 72. This rack is similar to the rack 60 in that it has opposite side panels 151, 152 mechanically locked to a back panel 153 by interengaged tabs 67, 68 and slots 70 along the adjacent side edges of the back and side panels, with shelves 154 supported on the back and side panels, but the construction of the side and back panels, the shelves, the shelf supports, and the graphics wrap applied to the side and back panels is different than in the previous embodiments.

Instead of a single row of slots 75 in the back panel as in the FIG. 37 embodiment, the back panel 153 in the rack 150 of the FIG. 72 embodiment has a double row of slots 75A and 75B, and the shelves 154 each has two tabs 76A and 76B that are engaged in the respective slots when the shelves are in operative assembled position. The tabs each have an opening 18 in the end portion projecting through the back panel, and a locking pin 17 is engaged in the openings to secure the tabs in position, as in the previous embodiments. Further, the upper end of the back panel is extended to form a graphics header 155.

Tongues 156, 157 project outwardly from opposite side edges of the shelves, and small circular holes 158, 159 are formed in the top and bottom surfaces, respectively, spaced inwardly slightly from the front edge of the shelf and closely adjacent the opposite side edges.

The side panels 151 and 152 are narrower than the side panels in the previous embodiments and are rectangularly shaped. Each side panel has a row of slots 160 arranged along its length and a narrow slit 161 spaced a short distance from each slot 160. When the shelves and side panels are in operative position, the tongues 156, 157 are extended outwardly through the slots 160 and a forward end thereof is folded rearwardly and inserted into a respective slit 161 as seen best in FIGS. 96-98 and 102, 103. The shelves are thus supported on the back panel by the tabs 76A, 76B engaged in slots 75A, 75B, and on the side panels by engagement of the tongues 156, 157 in the slots 160 and slits 161.

The shelf supports in this form of the invention comprise a plurality of rods or poles 165 extended between adjacent shelves and engaged at their opposite ends in the holes 158, 159, respectively.

A skirt assembly 170 is positioned beneath the bottom shelf and includes a pair of short poles 165' engaged at their upper ends in holes 159' in the underside of the upper panel 171 of the skirt assembly and extending at their lower ends to contact a support surface on which the display rack is resting. The poles 165' are in alignment with the poles 165 extending between the shelves 154, whereby the front portions of all the shelves are effectively supported from the supporting surface.

Depending flanges 172 and 173 extend across the front and sides, respectively, of the skirt assembly to hide the space beneath the bottom shelf.

A graphics wrap 180 in this form of the invention includes a back panel 181 that extends completely across the back of the display rack, side panels 182 and 183 that extend across the side panels of the rack, and flanges 184 that fold around and cover the front edges of the side panels 151, 152 of the rack and are frictionally engaged between adjacent shelves to hold the graphics wrap in place.

Figure 76:
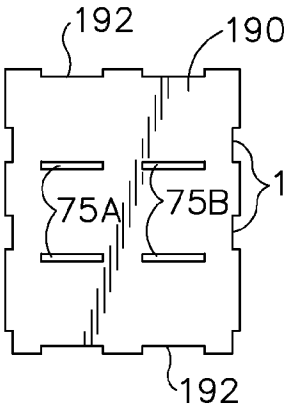
FIG. 76 is a plan view of a cover panel for placement on the front of the back panel between the top and bottom shelves.
Figure 75:
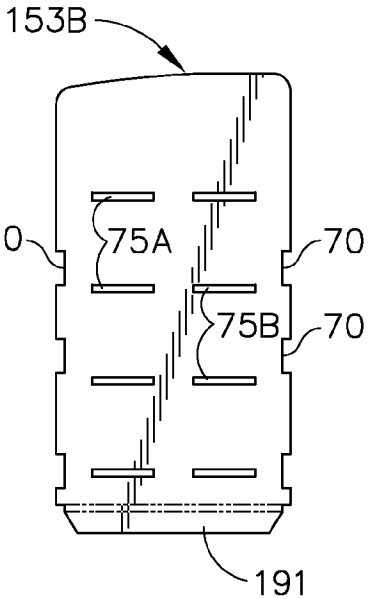
FIG. 75 is a plan view of a second blank used in the manufacture of the back panel of the FIG. 72 embodiment.
Figure 74:
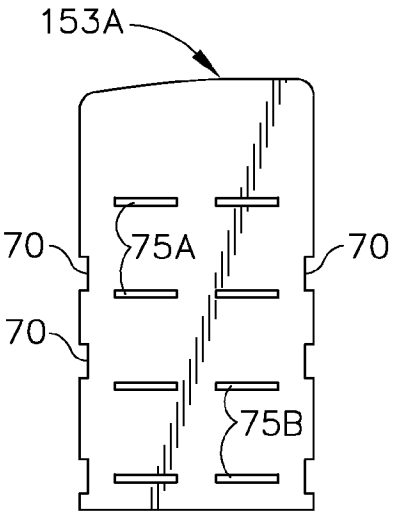
FIG. 74 is a plan view of a first blank used in the manufacture of the back panel of the FIG. 72 embodiment.

As shown in FIGS. 74-76, the back panel 153 is composed of three blanks or sheets 153A laminated with a sheet 153B, and a graphics panel 190 applied to the front of the back panel and that spans the distance between the top and bottom shelves. The sheet 153B forms the outer surface of the back panel in an assembled rack and has a flange 191 on its bottom end that is wrapped around the bottom ends of the laminated sheets 153A. Shallow recesses 192 are formed in the top and bottom edges of the graphics panel, providing clearance for the tabs 76A, 76B on the backs of the shelves, and similar shallow recesses 193 are formed in the side edges to provide clearance for the tabs 67, 68 on the side edges of the side panels. In a particular example of the display rack described herein, the sheets 153A and 153B are made of 61-BC-KRAFT/40, and the graphics panel is made of 32-B-MWOS.

Figure 78:
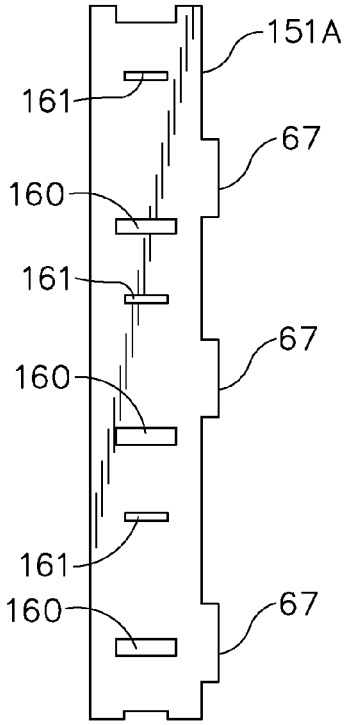
FIG. 78 is a plan view of a first blank used in the manufacture of a side panel of the FIG. 72 embodiment.
Figure 79:
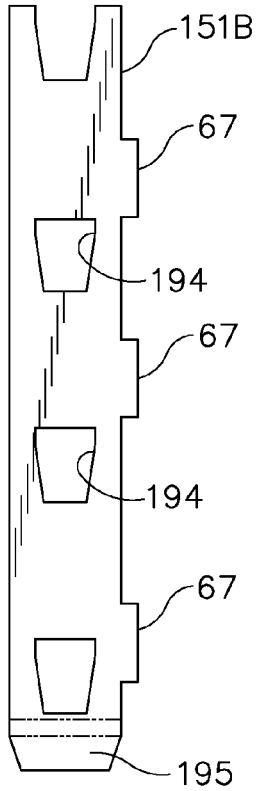
FIG. 79 is a plan view of a second blank used in the manufacture of a side panel of the FIG. 72 embodiment.
Figure 80:
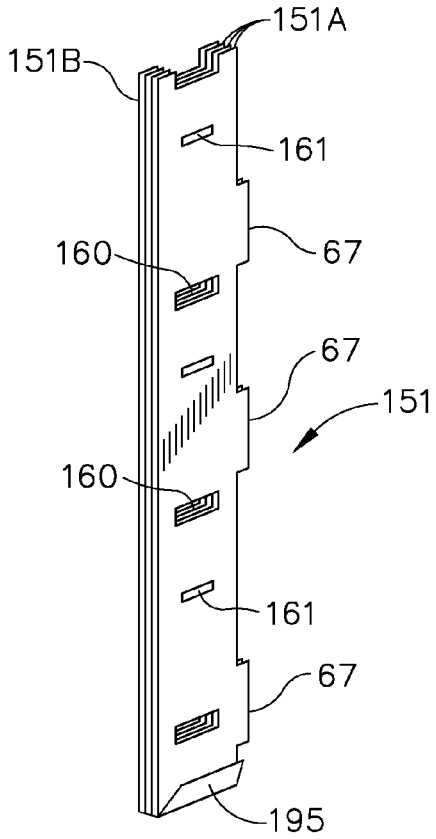
FIG. 80 is a perspective view of a side panel, shown slightly exaggerated, made up of the blanks of FIGS. 78 and 79 laminated together.

FIGS. 78-80 depict the blanks or sheets that are used to make one of the side panels 151 or 152. Since the side panels are identically constructed, only side panel 151 will be descried. Side panel 151 is composed of three blanks or sheets 151A laminated with a sheet 151B. Sheet 151B forms the outer surface of the side panel when operatively installed in a rack and has a plurality of cutouts 194 shaped like the tongues 156, 157, whereby when the flange is folded into operative locked position it is flush with the outer surface of the side panel. A flange 195 on its bottom end is folded around the bottom ends of the laminated sheets 151A, as shown in FIG. 80. In the particular example described herein, the blanks 151A and 151B are made of 61-BC-KRAFT/40.

The side panels and back panels preferably are made of a moisture resistant material such as ClimaGuard® by International Paper Company.

Figure 81:
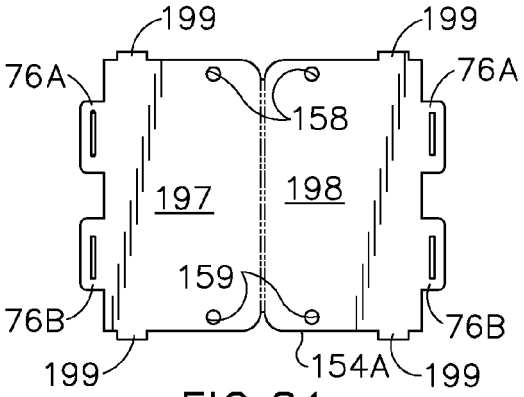
FIG. 81 is a top plan view of a blank used in the manufacture of a shelf as used in the FIG. 72 embodiment.
Figure 82:
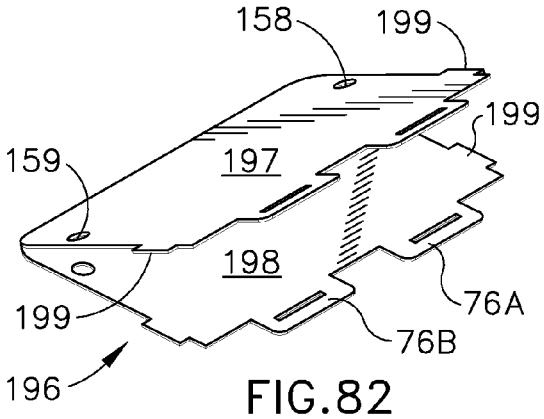
FIG. 82 is a perspective view showing the blank of FIG. 81 being folded into operative relationship to form an inner shelf component.

FIG. 81 shows a blank 154A for making an inner part or core 196 of a shelf 154. The blank comprises two panels 197, 198 foldably joined along an edge opposite the edges on which tabs 76A, 76B are formed, and FIG. 82 shows how the blank is folded to make one piece used in making the core. Two of these pieces are laminated together for each shelf.

Small tabs 199 project outwardly from the sides of the core adjacent the edge on which the tabs 76A, 76B are formed. In the particular example described herein, the blank is made of 61-BC-KRAFT/40.

Figure 83:
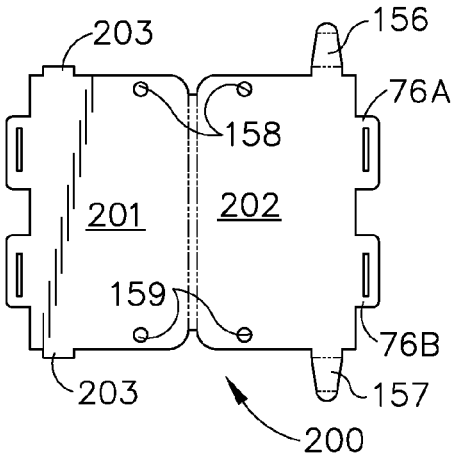
FIG. 83 is a top plan view of a blank for making an outer shelf wrap used in the manufacture of a shelf as used in the FIG. 72 embodiment.
Figure 84:
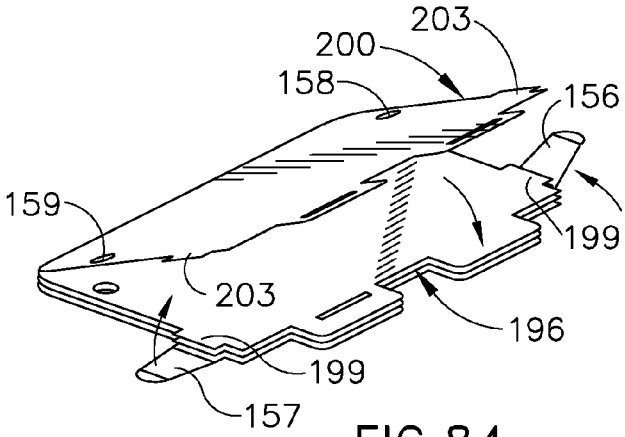
FIG. 84 is a perspective view showing the wrap of FIG. 81 being applied to the inner shelf component of FIG. 82.

A blank or sheet 154B for making a shelf wrap 200 is shown in FIG. 83, and in FIG. 84 the wrap is shown being applied to the core 196. The wrap comprises two panels 201, 202 foldably joined along an edge opposite the edges on which tabs 76A, 76B are formed. Small tabs 203 project from opposite side edges of panel 201 in positions corresponding to the tabs 199 on the core, and the tongues 156, 157 project outwardly from opposite side edges of panel 202 in positions corresponding to the positions of the tabs 199 and 203. In the particular example described herein, the wrap is made of 44-B-KRAFT.

When a shelf 154 is assembled to the rack, the tabs 199 and 203 on the side edges of the shelves are engaged along with the tongues 156, 157 in slots 160 in the rack side panels.

Figure 85:
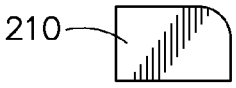
FIG. 85 is a top plan view of a stop that is placed between the laminations of the shelf in positions to block movement of the support rods completely through the shelf.

FIG. 85 shows a pole stop 210 that is placed between the center laminations in each shelf at the locations of the holes 158, 159 to limit the extend of insertion of a pole 165 or 165' into the holes so that the poles extend at their ends only about half way through the thickness of a shelf. In the particular example described herein, the pole stops are made of 32-E-KRAFT.

Figure 86:
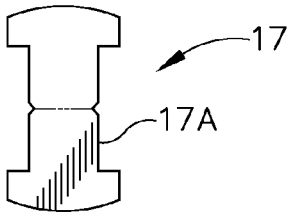
FIG. 86 is a top plan view of a blank used to make the lock pin.

FIG. 86 shows a blank 17A for making a pin 17, as in the previous forms of the invention.

Figure 87:
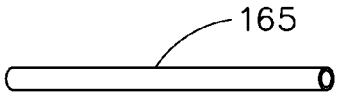
FIG. 87 is a perspective view of a first support rod that is placed below the bottom shelf in the rack of FIG. 72.
Figure 88:
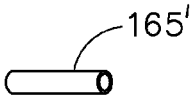
FIG. 88 is a perspective view of a second support rod that is placed between adjacent shelves.

FIGS. 87 and 88 show the fiber shelf-supporting poles 165 and 165' used in the embodiment of FIG. 70. In the specific construction disclosed herein, the longer pole has a length of about 11⅜ inches, the shorter pole has a length of about 3¾ inches, and both have a diameter of about 1¼ inches.

Figure 89:
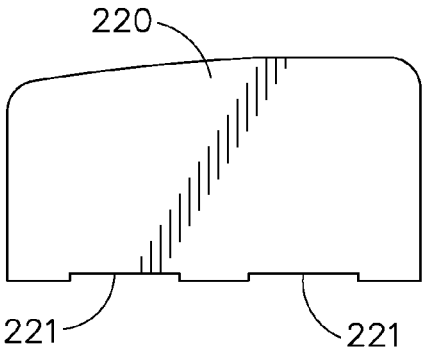
FIG. 89 is a plan view of a header graphics panel that is placed on the header.

FIG. 89 shows a header graphics panel 220 that is applied to the front top surface of the back wall. In the particular example disclosed herein, the header graphics panel 220 is made of 32-B-KRAFT, and has notches 221 in its bottom edge for clearance of the tabs 76A, 76B on the back edge of the top shelf in an assembled rack.

Figure 90:
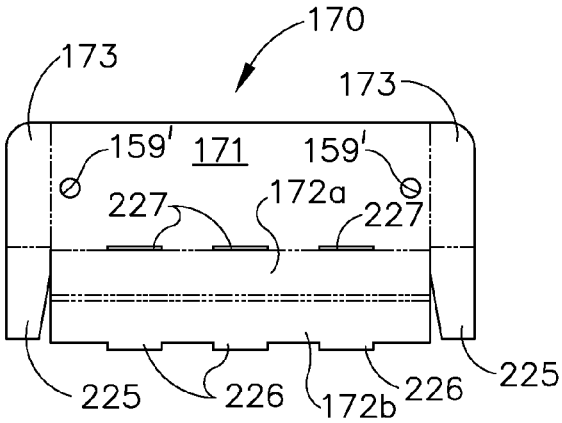
FIG. 90 is a plan view of a blank used to make a skirt that is positioned beneath the bottom shelf in the rack of FIG. 72.

The blank for making the skirt assembly 170 is shown in FIG. 90. The blank comprises the upper panel 171, side flanges 173, first and second front flange parts 172A, 172B that are folded to make the front depending flange 172, and tabs 225. To erect the skirt assembly, flanges 173 and tabs 225 are folded upwardly and tabs 225 are then folded inwardly. Front flange part 172A is then folded upwardly against tabs 225, and second front flange part 172B is then folded inwardly and downwardly over the tabs 225, with the narrow tabs 226 on the bottom edge of second flange part engaged in slots 227 to hold the skirt assembly in folded orientation. The shorter shelf support poles 165' are inserted through the holes 159' in the panel 171 and into the holes 159 in the bottom surface of the bottom shelf to form a wrap.

Figure 91:
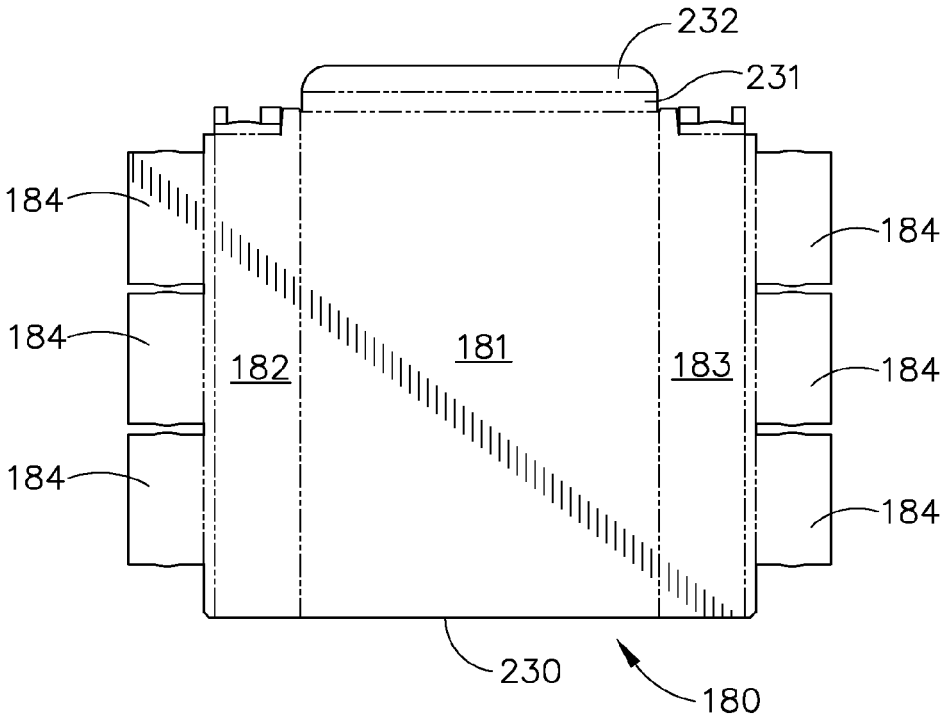
FIG. 91 is a plan view of a graphics wrap that is positioned on the outside of the back and side panels.
Figure 92:
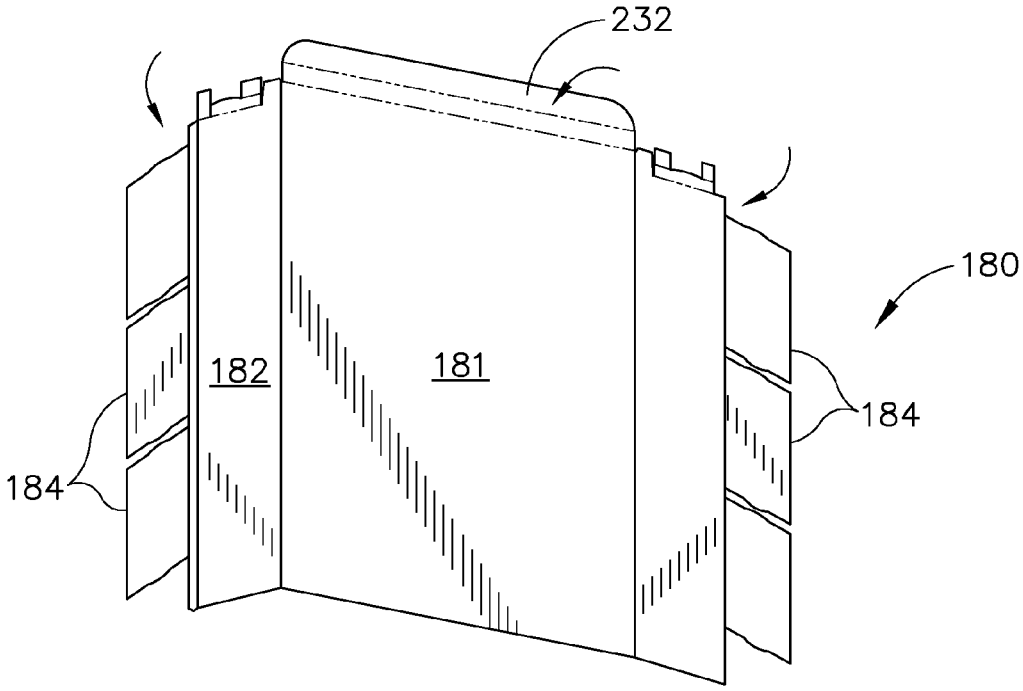
FIG. 92 is a perspective view of the graphics wrap of FIG. 91 in partially folded orientation.

A blank for making the graphics wrap 180 is shown at 230 in FIG. 91. The blank includes a first flange 231 folded to the top of back panel 181, and a second flange 232 folded to the first flange. When the wrap is applied to a display rack, the flanges 231 and 232 are folded inwardly and downwardly over the top edge of the back wall of the rack. In the particular example disclosed herein, the wrap is made of 32-B-MWOS.

Figure 93:
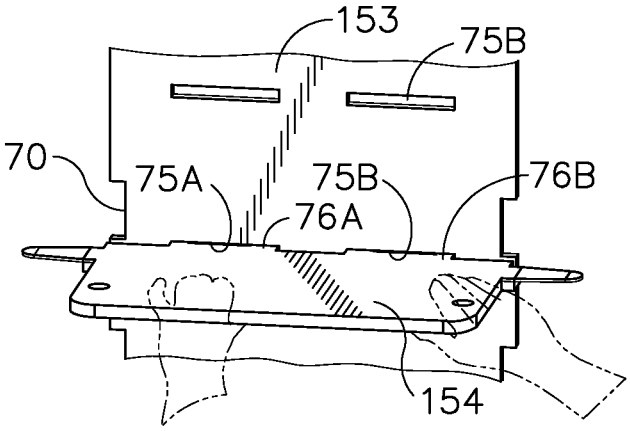
FIG. 93 is a fragmentary perspective view showing a shelf being attached to the back panel of the rack of FIG. 72.
Figure 94:
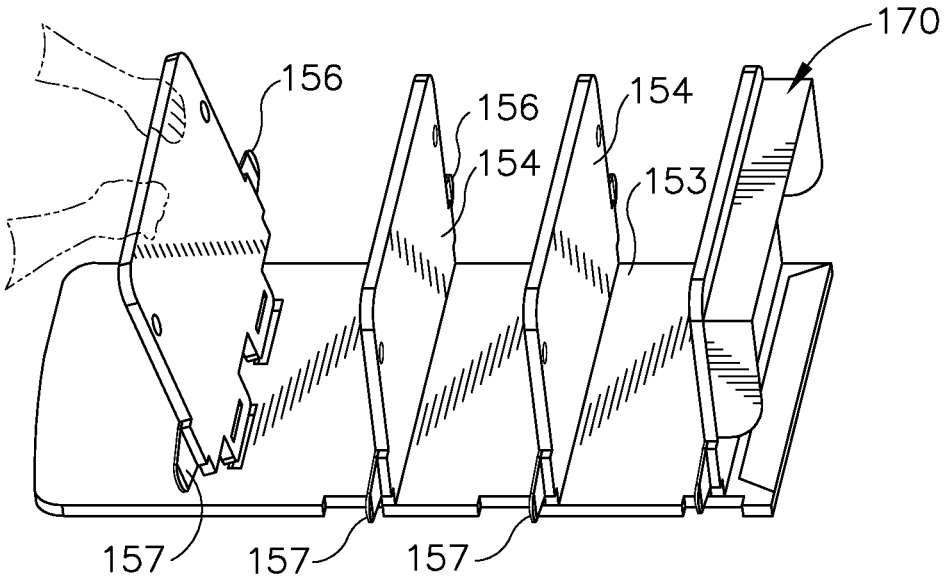
FIG. 94 is a perspective view showing attachment of a final shelf in a series of four.
Figure 95:
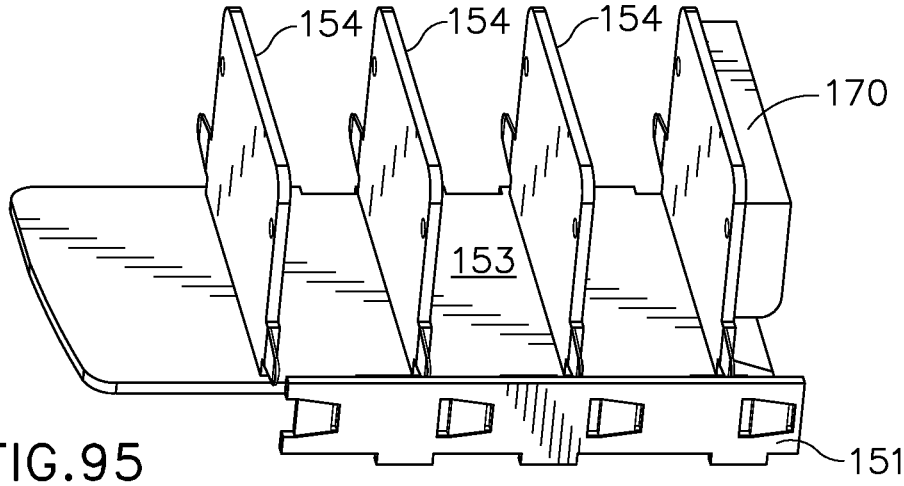
FIGS. 95-98 depict one of the side panels being attached to one end of the shelves and corresponding side edge of the back panel.
Figure 96:
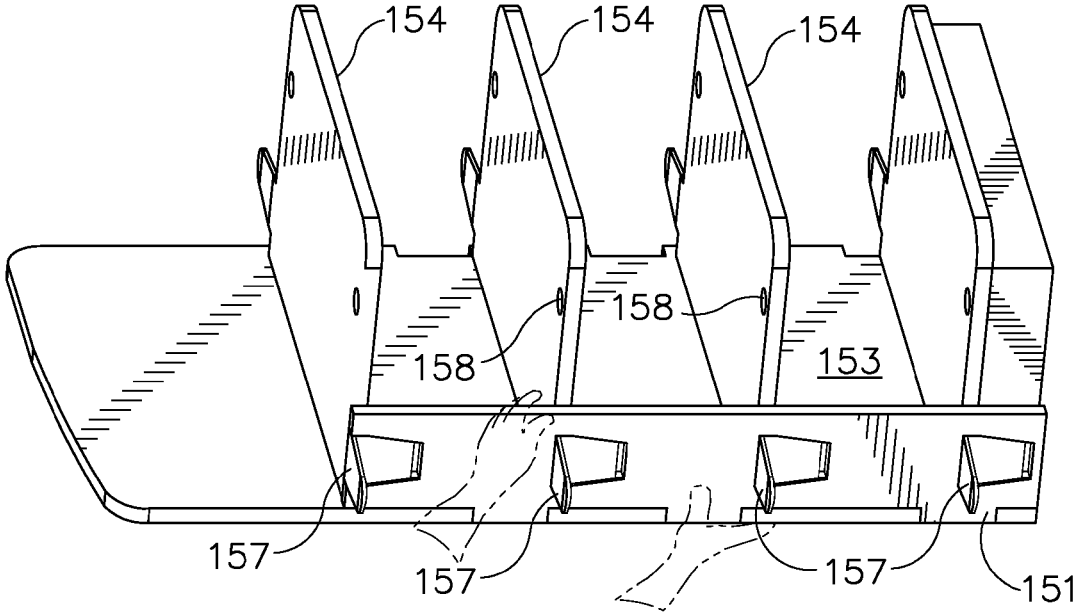
Figure 97:
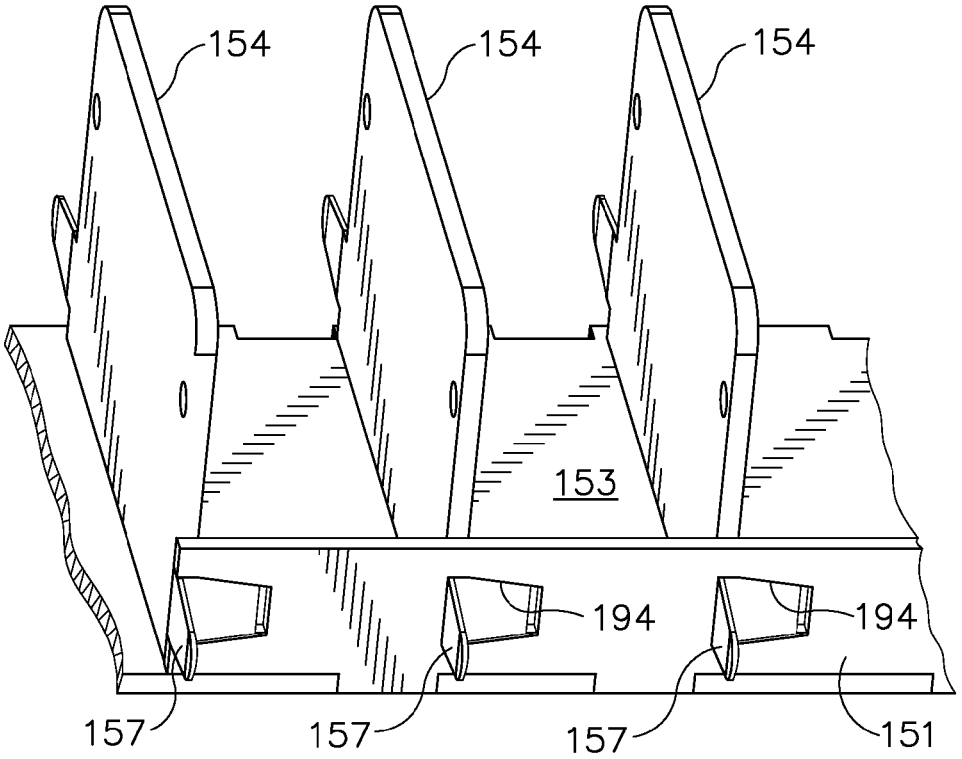
Figure 98:
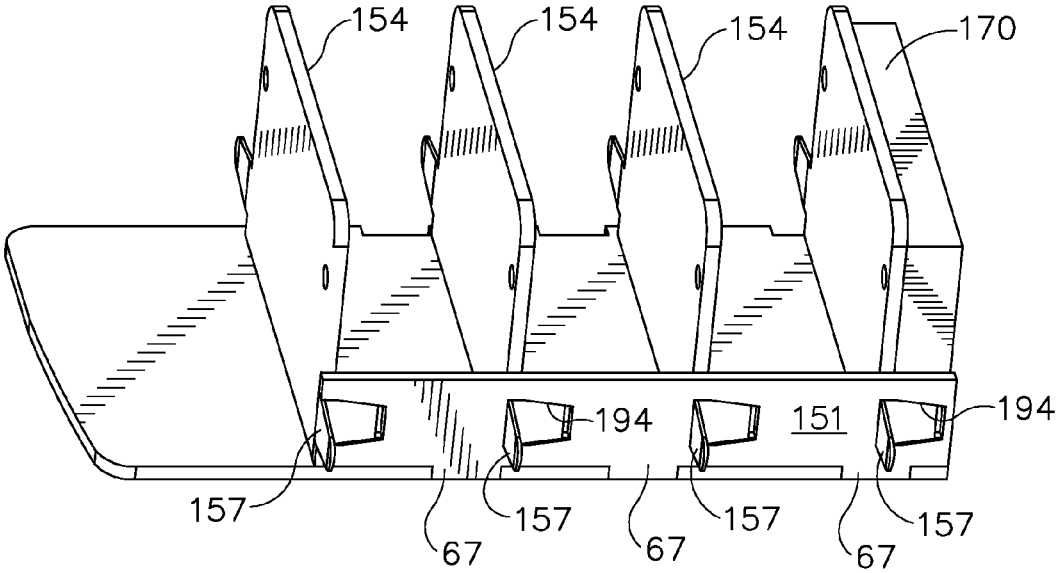
Figure 99:
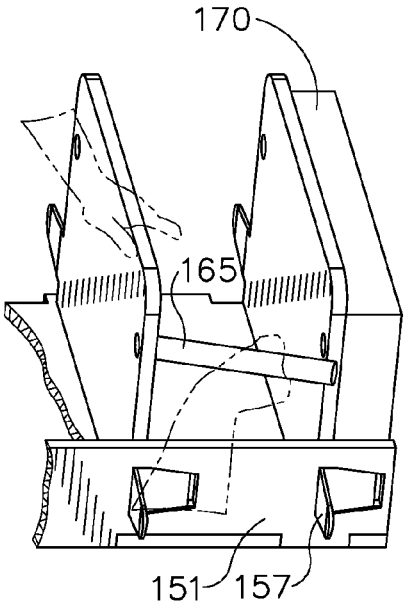
FIGS. 99 and 100 show the support rods being positioned in the openings provided in the shelves for that purpose.
Figure 100:
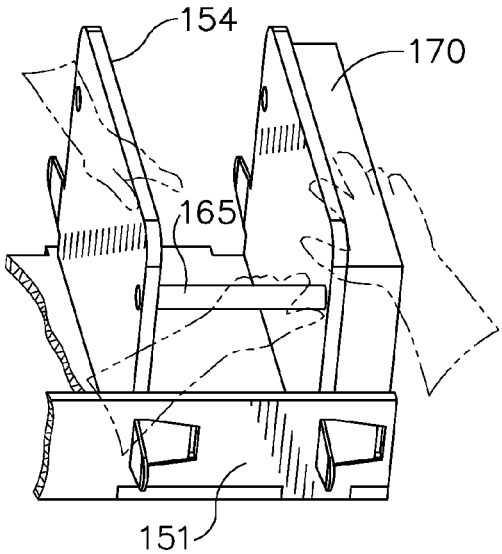
Figure 101:
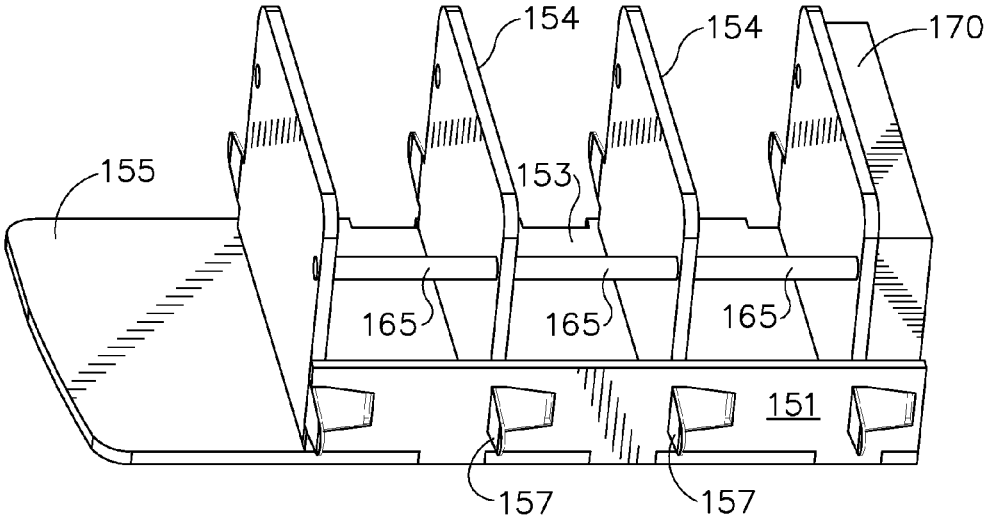
FIG. 101 shows the rods fully assembled to the shelves, and the locking tongues on the ends of the shelves extended through slots in the side panels and ready to be folded into locked position.
Figure 102:
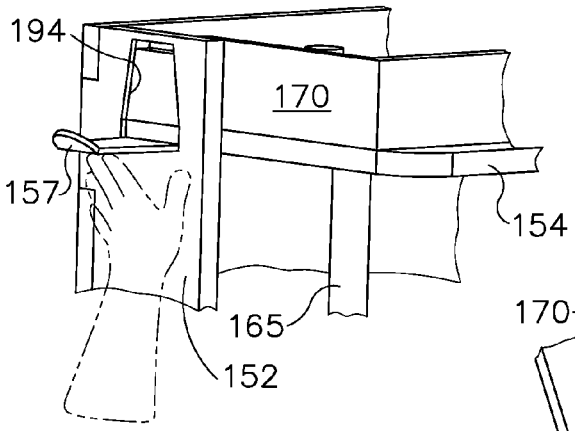
FIGS. 102-104 show the locking tongues being moved into locked position.
Figure 103:
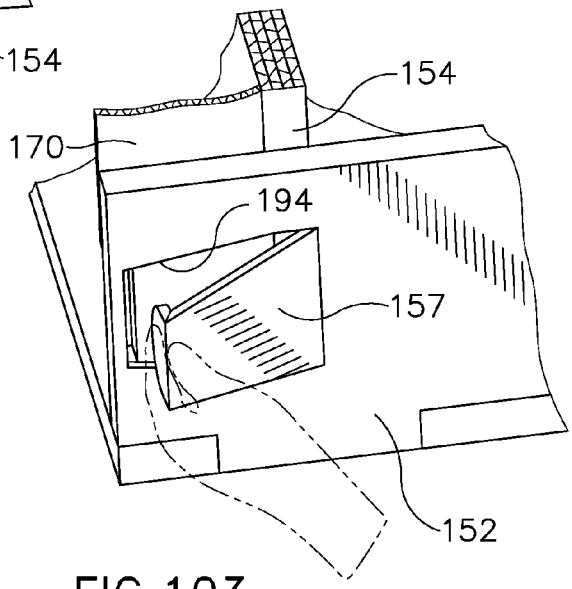
Figure 104:
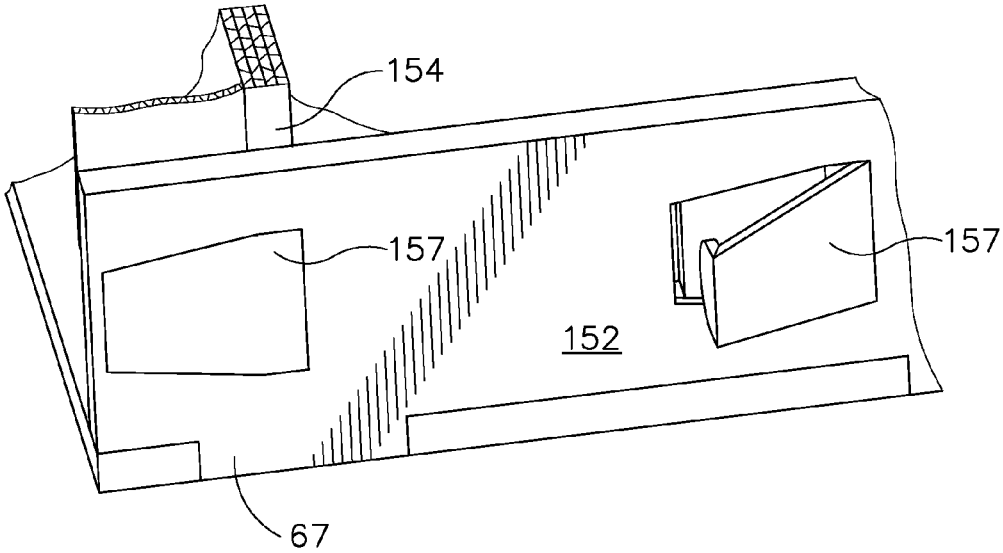
Figure 105:
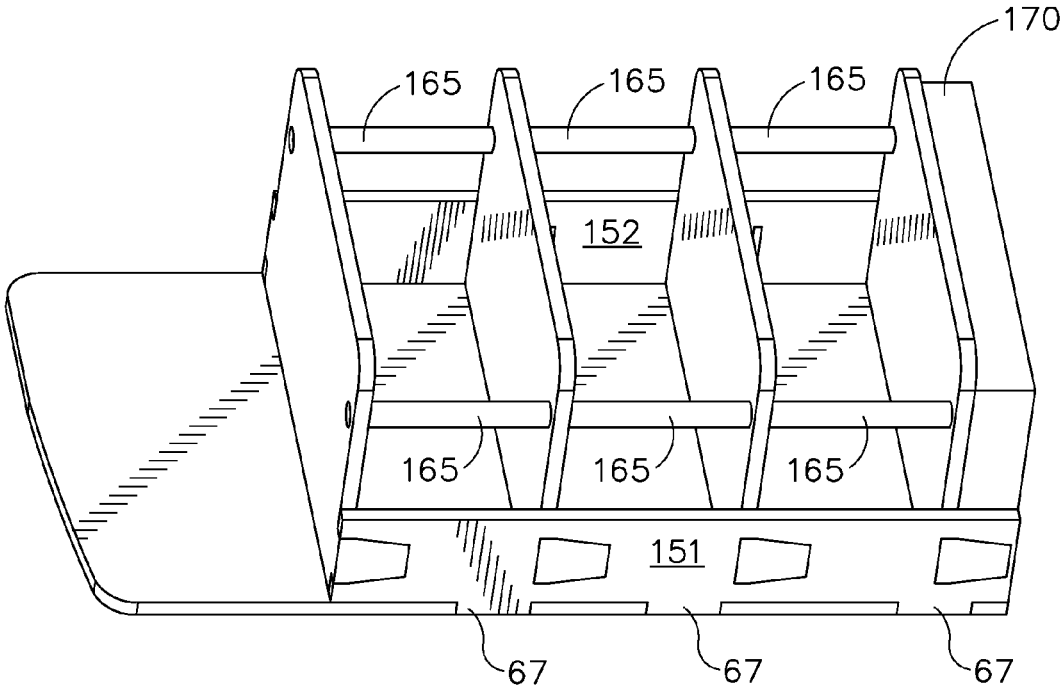
FIG. 105 shows the rack with all the tongues in folded locked position to secure the side panels to the ends of the shelves and all the rods in operative assembled position.
Figure 106:
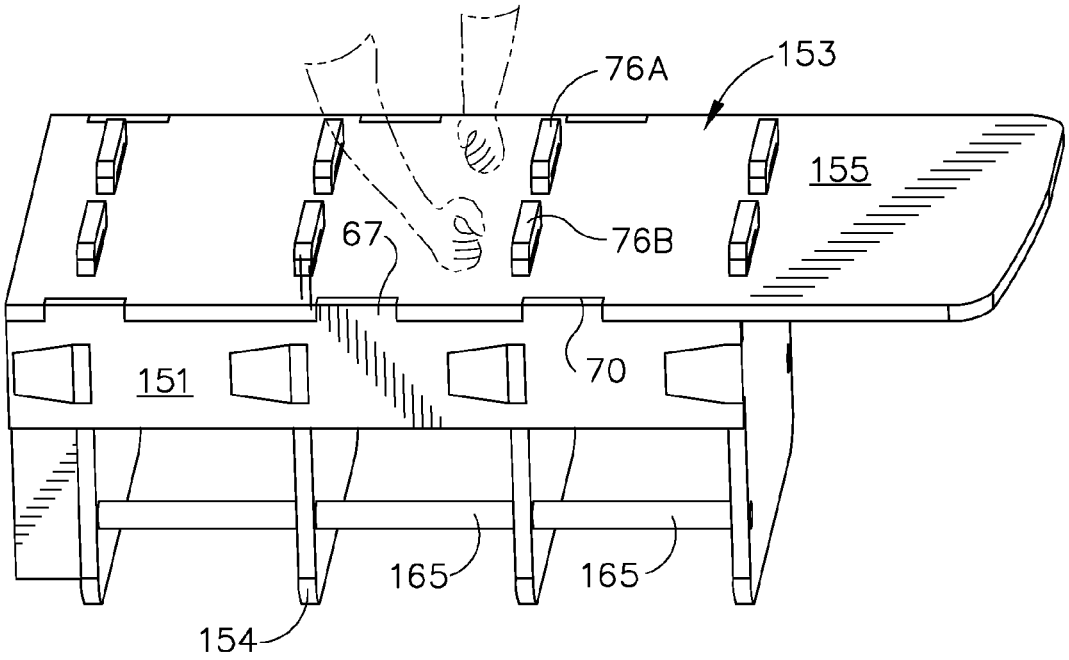
FIG. 106 shows the rack flipped over onto its front, and the back panel being pressed into operative position to fully engage the tabs and notches at the adjacent side edges of the side and back panels and to fully extend the tabs on the back edges of the shelves through the slots in the back panel.
Figure 107:
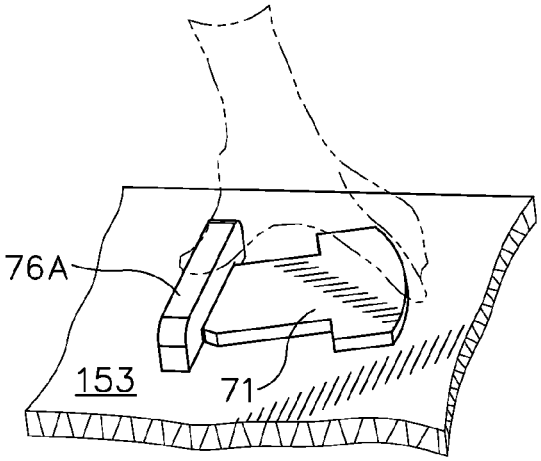
FIG. 107 shows a locking pin being inserted into the opening provided for that purpose in the end of the locking pin that projects through the tab on the shelf.
Figure 108:
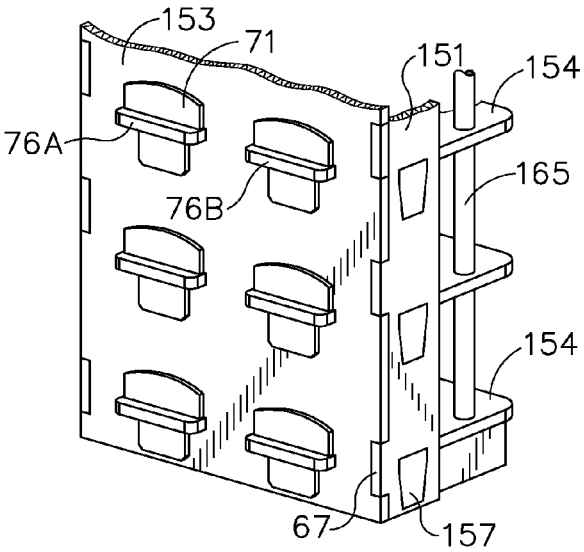
FIG. 108 is a fragmentary rear perspective view of the rack of FIG. 70, showing the locking pins and locking tongues in operative position to secure the rack components together.
Figure 109:
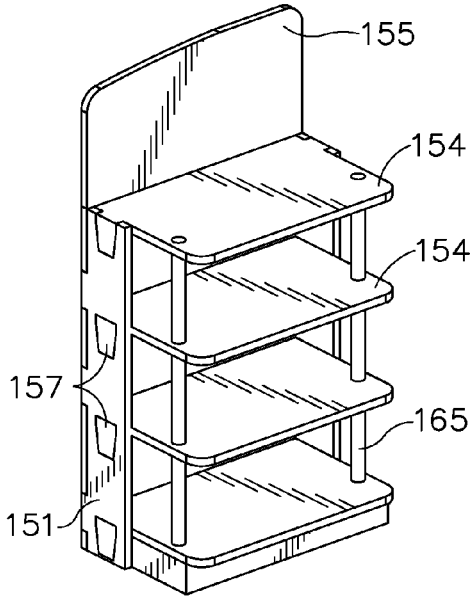
FIG. 109 is a front perspective view of the rack of FIG. 70 prior to application of the graphics wrap.
Figure 110:
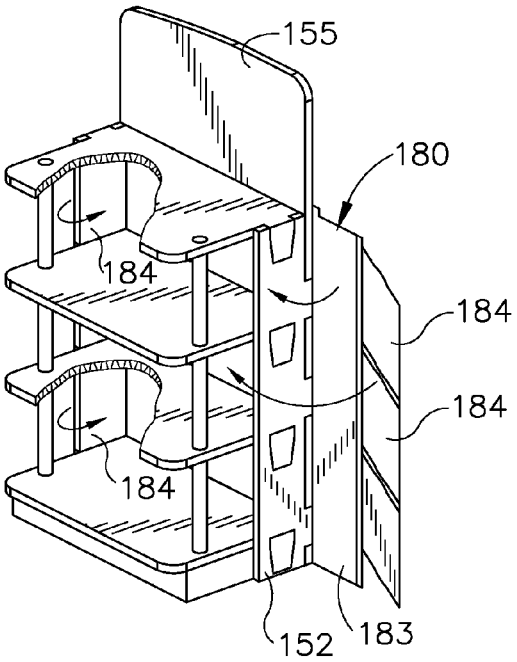
FIG. 110 is a fragmentary front perspective view showing the graphics wrap being applied to the rack.
Figure 111:
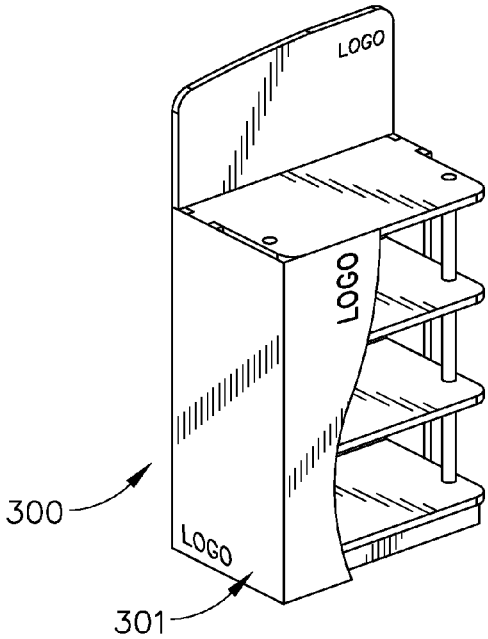
FIG. 111 is a front perspective view of a variation of the rack shown in FIG. 70, wherein the graphics wrap extends over only a portion of the back but extends completely over one side of the rack and partially over the front.
Figure 112:
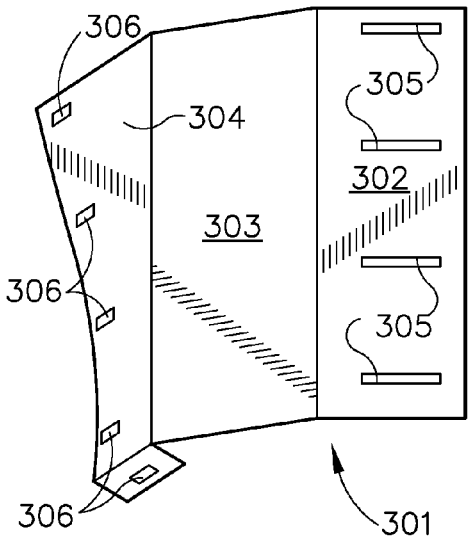
FIG. 112 is a perspective view of the graphics wrap used in the FIG. 109 embodiment, shown slightly folded.

The steps of assembling the rack 150 are shown in sequence in FIGS. 93-110, and are believed to be self-explanatory. Briefly, FIGS. 93-95 show the shelves 154 being assembled to the back panel 153 by inserting the tabs 76A, 76B into the slots 75A, 75B. The side panels 151 and 152 are then installed, as shown in FIGS. 96-98, by moving them into position and inserting the tongues 156, 157 and tabs 199, 203 on opposite side edges of the shelves through the slots 160 in the side panels. The shelf support poles 165 are then installed, as shown in FIGS. 99-101, followed by folding of the tongues and insertion of the forward end thereof into the slits 161 in the side panels as shown in FIGS. 102-104. The assembly is then turned onto its face as seen in FIG. 106 and pressure exerted against the back panel 153 to ensure that the tabs and notches along adjacent side edges of the back and side panels, and the shelf tabs extended through the slots in the back panel, are all fully seated. The locking pins 17 are then inserted into the openings 18 in the ends of the tabs extended through the back panel as shown in FIGS. 107 and 108. Thereafter, as shown in FIG. 110, the graphics wrap 180 is wrapped around the back and side panels of the display rack and the flanges 184 are inwardly folded and inserted between adjacent shelves, where the flanges are held by friction to retain the graphics wrap in place.

Figure 113:
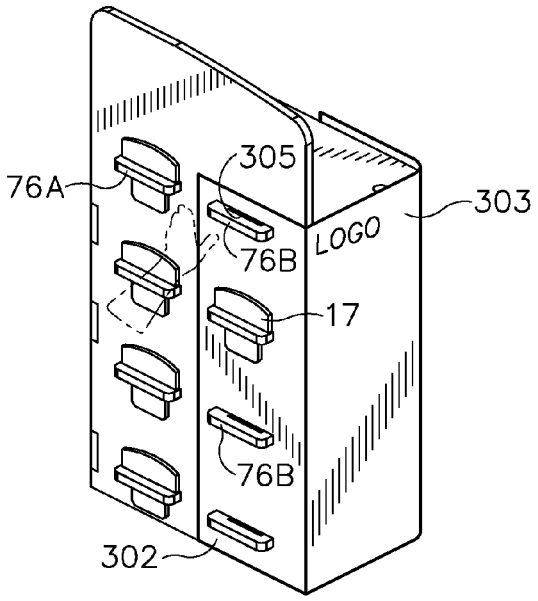
FIG. 113 is a fragmentary rear perspective view showing the rear portion of the graphics wrap being applied to the back of the rack, and depicting how the locking pins that hold the shelves to the back panel also serve to hold the back panel of the graphics wrap attached to the back panel of the rack.
Figure 114:
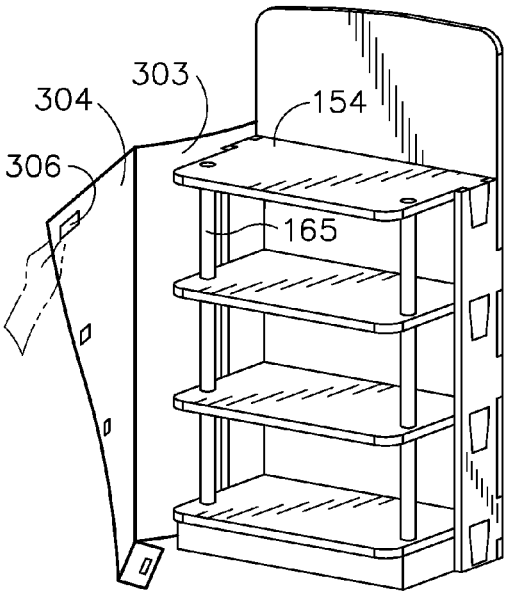
FIG. 114 is a fragmentary perspective view showing the front panel of the graphics wraps being positioned for attachment to the front of the rack.
Figure 115:
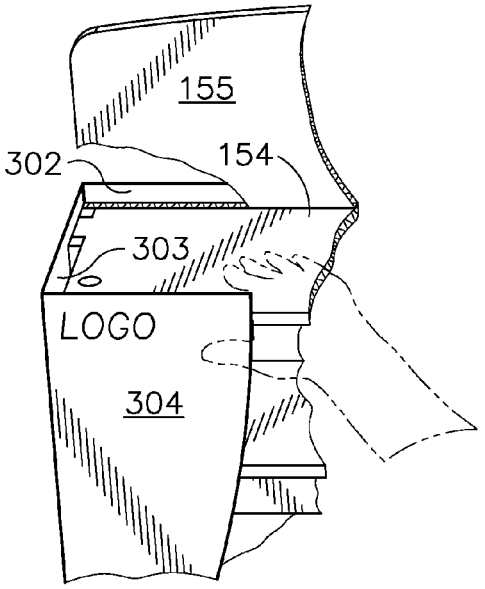
FIG. 115 shows the front panel of the graphics wrap being pressed into place.

A variation of the FIG. 72 embodiment is shown at 300 in FIGS. 111-115. This form of the invention is structurally the same as the FIG. 72 embodiment, but it has a different graphics wrap 301. In this form of the invention, the graphics wrap 301 has a back panel 302 adapted to extend across one side edge portion of the back panel of the display rack, a side panel 303 adapted to extend across one side of the rack, and a front panel 304 adapted to extend across one edge portion of the front of the display rack. As seen in FIG. 113, the back panel 302 has a plurality of slots 305 therein adapted to receive the tabs 76A that extend through the set of slots adjacent one side edge of the back panel, and a plurality of pieces of double face tape 306 are placed on the inside surface of the front panel in positions corresponding to the locations of the shelves. To install this wrap, the back panel 302 is first placed over the tabs 76A and the pins 17 then inserted to hold the back panel in place. The wrap is then folded around the side and front panels and the double face tape adhered to the fronts of the shelves.

All of the components of the various embodiments of racks disclosed herein are made of 100% recyclable materials, e.g. fiber-based containerboard, and at least the structural components comprise multiple sheets laminated together. At least some of the components, and particularly the side panels and back panels comprise a material that is treated to enhance its moisture resistance. A suitable material is ClimaGuard® containerboard by International Paper Company.

Although specific flute combinations and materials have been described herein, it should be understood that the disclosed materials were selected for a particular purpose, and it is within the scope of this invention that other materials could be employed depending upon the intended use and requirements of the display rack.

The mechanical interlocks provided by the tabs, slots and locking pins, and the laminated construction of the components, form a very strong, rigid structure that resists twisting and is durable over prolonged periods of use in a retail environment. The components can be shipped flat in a very compact package, and can be quickly and easily assembled without requiring the use of tools.

While particular embodiments of the invention have been illustrated and described in detail herein, it should be understood that various changes and modifications may be made in the invention without departing from the spirit and scope of the invention as defined by the appended claims.

What is claimed is:

1. A freestanding display rack for supporting and displaying product at a point of sale comprising:

a pair of spaced apart side panels;

a plurality of shelves extending between and supported at their opposite ends on the side panels by mechanical interlocking means engaged between the shelves and the side panels, the mechanical interlocking means comprising slots (16) formed through the side panels adjacent each of the shelves, and a tongue projecting outwardly from each end of the shelves, the tongues extending through the respective slot (16) in the side panels and being folded against an outer surface of the respective side panel wherein the tongues project outwardly from the shelves in generally coplanar relationship with a top surface of the respective shelves and a tab projects outwardly from each of the shelves in generally coplanar relationship with a bottom surface of the respective shelves and adjacent and below each of the tongues, the tabs being received in the same slots (16) that the tongues are extended through; and a graphics header extending above the shelves and side panels.

2. The freestanding display rack of claim 1, wherein:

the display rack includes a back panel that is attached to the side panels by interfitting tabs and notches along adjacent edges of the back panel and the side panels.

3. The freestanding display rack of claim 2 further comprising:

a separate graphics wrap is applied to the display rack, the graphics wrap having a wrap back panel overlying the back panel of the display rack, and opposite side panels overlying the side panels of the display rack.

4. The freestanding display rack of claim 3, wherein:

flaps on forward edges of the graphics wrap are folded inwardly between each pair of adjacent shelves and frictionally engaged at top and bottom edges thereof between adjacent shelves to hold the graphics wrap in place on the rack.

5. The freestanding display rack of claim 2, further comprising:

a separate graphics wrap is applied to the display rack, the graphics wrap having a wrap back panel overlying a portion of the back panel of the display rack, one side panel overlying one side panel of the display rack, and a front panel overlying a portion of the front of the display rack.

6. The freestanding display rack of claim 2, wherein:

the back panel has a plurality of slots (75) formed therethrough; and each of the shelves has at least one tab integral with a rearward edge thereof, the at least one tab extending through one of the plurality of slots (75) to attach the shelves to the back panel.

7. The freestanding display rack of claim 6, wherein:

openings are formed in an end of each of the tab projecting through the respective plurality of slots (75); and a locking pin is engaged in each of the openings to prevent withdrawal of the respective tabs from the respective slots.

8. The freestanding display rack of claim 6, wherein:

the plurality of slots (75) comprise first and second horizontally spaced apart columns of vertically arrayed slots; and the at least one tab on a rearward edge of each of the shelves comprises first and second tabs, the first tabs are positioned to extend through the slots of the first column and the second tabs are positioned to extend through the vertically arrayed slots of the second column.

9. The freestanding display rack of claim 8, wherein:

the side panels each have a width half the distance between front and back edges of the shelves.

10. The freestanding display rack of claim 8, wherein:

the wrap back panel of the graphics wrap has the plurality of vertically arrayed slots formed therein, and one of the first and second tabs projecting through the vertically arrayed slots of one of the first and second columns of slots being extended through the slots in the back panel of the graphics wrap; and adhesive means are on an inner surface of the front panel of the graphics panel in positions corresponding to the locations of the shelves, the adhesive means securing the front panel of the graphics wrap to the front of the rack.

11. The freestanding display rack of claim 1, further comprising:

shelf supports extend between adjacent shelves, the shelf supports comprising a pole located at each of the outer front corners of the shelves, opposite ends of the poles being seated in openings in respective top and bottom surfaces of the shelves.

12. The freestanding display rack of claim 11 further comprising:

a skirt assembly (170) positioned beneath the bottom shelf in the display rack, the skirt assembly including a pair of support poles adapted to contact a supporting surface on which the display rack rests and being in axial alignment with the poles extending between the shelves.

13. The freestanding display rack of claim 1 wherein the display rack is made entirely of materials that can be recycled by utilizing existing fiber recycling chains and can be shipped to the point of sale in a knocked-down flattened condition in a compact package and assembled at the point of sale without using tools.

14. A freestanding display rack for supporting and displaying product at a point of sale, wherein the display rack is made entirely of materials that can be recycled by utilizing existing fiber recycling chains and can be shipped to the point of sale in a knocked-down flattened condition in a compact package and assembled at the point of sale without using tools, the display rack comprising:

a pair of spaced apart side panels;

a back panel attached to the side panels by interfitting tabs and notches along adjacent edges of the back panel and the side panels;

a plurality of shelves extending between and supported at their opposite ends on the side panels by mechanical interlocking means engaged between the shelves and the side panels, the mechanical interlocking means comprises a slot formed through the side panels adjacent each of the shelves, and a tongue projecting outwardly from each end of the shelves, the tongues extending through the respective slot in the side panels and being folded against an outer surface of the respective side panel wherein the tongues project outwardly from the shelves in generally coplanar relationship with a top surface of the respective shelves and a tab projects outwardly from each of the shelves in generally coplanar relationship with a bottom surface of the respective shelves and adjacent and below each of the tongues, the tabs being received in the same slots (16) that the tongues are extended through and, shelf supports extend between adjacent shelves, the shelf supports comprising a pole located at each of the outer front corners of the shelves, opposite ends of the poles being seated in openings in respective top and bottom surfaces of the shelves; and a graphics header extending above the shelves and side panels.

15. The freestanding display rack of claim 14 further comprising:

a skirt assembly is positioned beneath the bottom shelf in the display rack, the skirt assembly including a pair of support poles adapted to contact a supporting surface on which the display rack rests and being in axial alignment with the poles extending between the shelves.

16. The freestanding display rack of claim 14 further comprising:

a separate graphics wrap is applied to the display rack, the graphics wrap having a wrap back panel overlying the back panel of the display rack, and opposite side panels overlying the side panels of the rack.

17. A disassembled kit having components of a display rack for supporting and displaying product at a point of sale comprising:

a pair of side panels each having an outer surface, and an inner surface facing an opposite side panel, the side panels made of multi-ply sheets of recyclable fiber-based material laminated together;

a back panel attached to the side panels by interfitting tabs and notches along adjacent edges of the back panel and the side panels;

a plurality of shelves extending between and supported at their opposite ends on the side panels by mechanical interlocking means engaged between the shelves and the side panels, the mechanical interlocking comprises a slot formed through the side panels adjacent each of the shelves, and a tongue projecting outwardly from each end of the shelves, the tongues extending through the respective slot in the side panels and being folded against an outer surface of the respective side panel wherein the tongues project outwardly from the shelves in generally coplanar relationship with a top surface of the respective shelves and a tab projects outwardly from each of the shelves in generally coplanar relationship with a bottom surface of the respective shelves and adjacent and below each of the tongues, the tabs being received in the same slots (16) that the tongues are extended through and wherein the shelves are made of multiply sheets of recyclable fiber-based material laminated together; and a graphics header extending above the shelves and side panels wherein the panels, the back wall, the plurality of shelves, and the graphics header are attached to one another to form the display rack.

18. The disassembled kit of claim 17 further comprising graphics covered on the side panels and the graphics header.

* * * * *